US011214907B2

(12) United States Patent
Xu et al.

(10) Patent No.: US 11,214,907 B2
(45) Date of Patent: Jan. 4, 2022

(54) COMBINED WASHING AND DRYING MACHINE

(71) Applicant: TCL HOME APPLIANCES (HEFEI) CO., LTD., Hefei (CN)

(72) Inventors: Wengen Xu, Anhui (CN); Benyang Bian, Anhui (CN); Tianyu Cui, Anhui (CN); Lin Zhang, Anhui (CN)

(73) Assignee: TCL HOME APPLIANCES (HEFEI) CO Ltd., Hefei (CN)

( * ) Notice: Subject to any disclaimer, the term of this patent is extended or adjusted under 35 U.S.C. 154(b) by 472 days.

(21) Appl. No.: 15/829,977

(22) Filed: Dec. 3, 2017

(65) Prior Publication Data

US 2018/0094378 A1 Apr. 5, 2018

Related U.S. Application Data

(63) Continuation of application No. PCT/CN2016/074560, filed on Feb. 25, 2016.

(30) Foreign Application Priority Data

Dec. 30, 2015 (CN) ..... 201521133759.3

(51) Int. Cl.
*D06F 25/00* (2006.01)
*D06F 58/24* (2006.01)
(Continued)

(52) U.S. Cl.
CPC ..... *D06F 25/00* (2013.01); *D06F 58/24* (2013.01); *F04D 29/281* (2013.01); *D06F 39/14* (2013.01); *D06F 58/26* (2013.01); *F04D 29/30* (2013.01)

(58) Field of Classification Search
CPC ..... D06F 58/24; D06F 58/26; D06F 58/20; D06F 25/00; D06F 39/14; F04D 29/281; F04D 29/23
(Continued)

(56) References Cited

U.S. PATENT DOCUMENTS 2,717,456 A * 9/1955 Smith ..... D06F 58/24 34/75
3,012,333 A * 12/1961 Leonard ..... D06F 58/24 34/75
(Continued)

FOREIGN PATENT DOCUMENTS

CN 1403649 3/2003
CN 1403649 A * 3/2003
(Continued)

OTHER PUBLICATIONS

Bing et al., "Condensing structure of drying system in high-efficiency washing machine with drying function" Sep. 2006, CN 1827903A—Machine Translation (Year: 2006).*
(Continued)

*Primary Examiner* — David G Cormier
*Assistant Examiner* — Thomas Bucci
(74) *Attorney, Agent, or Firm* — Nathan & Associates; Menachem Nathan

(57) ABSTRACT

A combined washing and drying machine is disclosed, including a roller, a condenser, a drying duct, a water inlet device and a drainage device. Hot and humid air inlet of the condenser is connected with the roller, dry air outlet of the condenser is connected with air inlet of the drying duct, and air outlet of the drying duct is connected with the roller to form a cycle wind path. The condenser inputs condensed water through the water inlet device, and discharges the condensed water after heat exchange through the drainage
(Continued)

device, and a plurality of water outlet holes are distributed in the water inlet device. The combined washing and drying machine is capable of cleaning clothing and drying clothing, thereby avoiding the need of manually and repeatedly accessing the clothing, and it is thus very convenient.

10 Claims, 22 Drawing Sheets

(51) Int. Cl.
*F04D 29/28* (2006.01)
*F04D 29/30* (2006.01)
*D06F 39/14* (2006.01)
*D06F 58/26* (2006.01)

(58) Field of Classification Search
USPC ..... 68/20, 19.2, 24, 18 C, 142, 18 R, 207, 68/12.14, 5 R; 34/73, 75, 77, 86, 82, 34/131, 610, 595
See application file for complete search history.

(56) References Cited

U.S. PATENT DOCUMENTS 4,112,590 A * 9/1978 Muller ..... D06F 25/00 34/75
4,154,003 A * 5/1979 Muller ..... D06F 25/00 34/469
4,338,730 A * 7/1982 Tatsumi ..... D06F 58/20 34/569
7,204,039 B2 * 4/2007 Cho ..... D06F 58/24 34/596
7,254,967 B2 * 8/2007 Kim ..... D06F 58/24 68/19.2
7,765,716 B2 * 8/2010 Kim ..... D06F 58/04 34/602
7,921,681 B2 * 4/2011 Lim ..... D06F 58/24 68/20
7,992,322 B2 * 8/2011 Kim ..... D06F 58/04 34/595
8,250,886 B2 * 8/2012 Lim ..... D06F 58/24 68/20
8,615,895 B2 * 12/2013 Shin ..... D06F 58/22 34/82
8,997,377 B2 * 4/2015 Kim ..... D06F 58/50 34/610
9,163,352 B2 * 10/2015 Han ..... D06F 58/38
2004/0045327 A1 * 3/2004 Kim ..... D06F 58/24 68/19.2
2004/0250442 A1 * 12/2004 Ryu ..... D06F 25/00 34/140
2005/0081575 A1 * 4/2005 Park ..... F28F 13/06 68/18 C
2006/0101870 A1 * 5/2006 Cho ..... D06F 58/24 68/19.2
2006/0101871 A1 * 5/2006 Inuzuka ..... D06F 25/00 68/23 R
2006/0169006 A1 * 8/2006 Lim ..... D06F 37/267 68/13 R
2006/0225467 A1 * 10/2006 Lim ..... D06F 25/00 68/20
2006/0225468 A1 * 10/2006 Hong ..... D06F 25/00 68/20
2007/0101602 A1 * 5/2007 Bae ..... D06F 58/206 34/77
2008/0276656 A1 * 11/2008 Kitamura ..... D06F 58/22 68/12.13
2010/0095548 A1 * 4/2010 Kim ..... D06F 58/24 34/73
2010/0162584 A1 * 7/2010 Ahn ..... D06F 58/24 34/73
2010/0192398 A1 * 8/2010 Ahn ..... F26B 21/08 34/79
2011/0062145 A1 * 3/2011 Yang ..... D06F 58/26 219/538
2011/0162415 A1 * 7/2011 Lim ..... D06F 37/26 68/20
2011/0167663 A1 * 7/2011 Lim ..... D06F 25/00 34/108
2012/0246960 A1 * 10/2012 Lee ..... D06F 58/22 34/86
2013/0008049 A1 * 1/2013 Patil ..... F26B 21/086 34/469
2013/0219734 A1 * 8/2013 Kim ..... F26B 21/003 34/82
2014/0047869 A1 * 2/2014 Kim ..... D06F 58/24 68/19.2
2014/0250710 A1 * 9/2014 Yang ..... F26B 21/086 34/73
2014/0298674 A1 * 10/2014 Liang ..... D06F 58/24 34/469
2015/0345866 A1 * 12/2015 Yu ..... F26B 25/005 34/73
2016/0115636 A1 * 4/2016 Kim ..... D06F 58/22 68/18 F
2016/0115638 A1 * 4/2016 Kim ..... D06F 58/20 34/499
2016/0115639 A1 * 4/2016 Kim ..... D06F 58/22 34/82

FOREIGN PATENT DOCUMENTS

CN 1609325 4/2005
CN 2701895 5/2005
CN 2795264 7/2006
CN 1827903 9/2006
CN 1827903 A * 9/2006
CN 1834333 9/2006
CN 2903145 5/2007
CN 102330316 1/2012
CN 105463812 4/2016
DE 102014201925 8/2015
EP 1 612 318 A2 1/2006
JP 2008178648 8/2008
JP 4512297 B2 7/2010

OTHER PUBLICATIONS

Kawamura et al., "Washing dryer and water-cooling heat exchanger" Mar. 2003, CN 1403649A—Machine Translation (Year: 2003).*

* cited by examiner

B-B

COMBINED WASHING AND DRYING MACHINE

CROSS REFERENCE TO RELATED APPLICATIONS

This application is a continuation of International Application No. PCT/CN2016/074560, filed Feb. 25, 2016.

BACKGROUND OF THE INVENTION

1. Field of the Invention

The present disclosure relates to the field of washing and drying machines, and more particularly to a combined washing and drying machine.

2. Description of the Prior Art

At present, clothes, bed sheets and other clothing are generally washed with a washing machine, and then the clean washing is dried through a specialized dryer. This kind of washing and drying method not only can quickly wash clothing, and can quickly dry clothing, and thus results in great convenience. However, this kind of washing and drying method needs to manually and repeatedly fetch the clothing and it is not very convenient. Furthermore, washing machines and dryers respectively occupy spaces. Therefore, the industry has developed a machine combined the washing function and the drying function. At present, the combined washing and drying machine condenses hot and humid air produced when the washing is dried by condensing of water. However, the drying performance is not satisfactory because of the low condensation efficiency.

SUMMARY OF THE INVENTION

It is a primary object of the present disclosure to provide a combined washing and drying machine which is intended to facilitate the cleaning and drying of clothing and to enhance the drying performance.

For achieving the above purpose, the present disclosure provides a combined washing and drying machine, including a roller, a condenser, a drying duct, a water inlet and a drainage device, wherein hot and humid air inlet of the condenser is connected with the roller, dry air outlet of the condenser is connected with air inlet of the drying duct, and air outlet of the drying duct is connected with the roller to form a cycle wind path; the condenser inputs condensed water through the water inlet, and discharges the condensed water after heat exchange through the drainage, and a plurality of water outlet holes are distributed in the water inlet.

Preferably, the condenser comprises at least one condensing plate and a housing, the condensing plate comprises a water inlet end, a water outlet end opposite the water inlet end, and at least one flow guide surface guiding the condensed water from the water inlet end to the water outlet end; a plurality of first heat exchange portions for slowing down flow rate of the condensed water flowing through the flow guide surface are protruded from the flow guide surface; the housing is disposed on an outer wall of the roller and encloses the roller to form a receiving cavity for receiving the condensing plate, the receiving cavity being connected with the air inlet of the drying duct and the roller.

Preferably, each first heat exchange portion is in a form of a plate, one end of the first heat exchange portion is fixed to the condensing plate and one other end opposite to the one end is suspended, a plate surface of the first heat exchange portion in the form of the plate faces a direction of the water inlet end, and the first heat exchange portion and the flow guide surface form an angle which opening is toward the direction of the water inlet end, and the angle is greater than or equal to 90 degrees.

Preferably, the condensing plate comprises two flow guide surfaces disposed opposite to each other, and the two flow guide surfaces are respectively provided with the first heat exchange portions, the first heat exchange portions on the two flow guide surfaces of the condensing plate are staggered.

Preferably, a second heat exchange portion is provided on one side of the housing facing the condensing plate.

Preferably, the water inlet comprises at least one bar-shaped container having an opening end and a closed end, the opening end of the bar-shaped container being provided with a water inlet joint, the water flowing into an inner cavity of the bar-shaped container through the water inlet joint; the bar-shaped container is provided with a mounting portion for matching installation with the condensing plate of the condenser, the bar-shaped container comprising a first side and a second side corresponding to two plate surfaces of the condensing plate, and the first side and the second side are respectively provided with a plurality of water outlet holes which are connected to the inner cavity of the bar-shaped container and are spaced apart along a direction from the opening end of the bar-shaped container to the closed end of the bar-shaped container.

Preferably, the condenser comprises two condensing plates disposed opposite to and spaced apart from each other, and the two condensing plates are connected to each other by a connecting member; the number of the bar-shaped container is two and the two bar-shaped containers are parallelly provided, opening ends of the two bar-shaped containers are respectively connected with the water inlet joint; each bar-shaped container comprises a main body extending in middle of the container, one end of the main body being provided with the water inlet joint, the main body comprising two mounting walls arranged parallel and opposite to each other, the two mounting walls each having a first water tank communicating with the water inlet joint; each mounting wall is provided with a first plate adhered thereto and each first plate being provided with a second water tank in a position corresponding to the first water tank, and the first water tank and the second water tank constitute the inner cavity of the bar-shaped container.

Preferably, the plurality of water outlet holes on the first side of the bar-shaped container are on a same horizontal line and/or the plurality of water outlet holes on the second side are on a same horizontal line.

Preferably, the plurality of water outlet holes on the first side of the bar-shaped container and the plurality of water outlet holes on the second side are on a same horizontal plane.

Preferably, the bar-shaped container, on a position each of the plurality of water outlet holes locates, is provided with a flow guide groove for guiding the water flow of the water outlet hole to the condensing plate.

Preferably, the bar-shaped container, on a position each of the plurality of water outlet holes locates, is provided with two baffles disposed in a vertical direction, and the flow guide groove is formed between the two baffles.

Preferably, an overflow hole is provided on the first side and/or the second side of the bar-shaped container, a distance between the overflow hole and a corresponding location on bottom of the inner cavity of the bar-shape container is greater than a distance between a water outlet hole and a corresponding location on bottom of the inner cavity of the bar-shape container.

Preferably, the drying duct comprises a drying impeller, an air passage, a turbine cavity, a heater, and a drying motor for driving rotation of the drying impeller, the air passage is connected with the turbine cavity, the drying impeller is arranged in the turbine cavity, the heater is arranged in the air passage, and a bottom of the turbine cavity, at a position corresponding to the drying impeller, is provide with an air inlet.

Preferably, the drying impeller comprises a fixing plate and a plurality of arc-shaped vanes, a middle of the fixing plate is provided with a fixing hole connected to a rotation shaft of the drying motor; an arc-shaped edge of the plurality of arc-shaped vanes is fixed to a bottom surface of the fixing plate, and the plurality of arc-shaped vanes are arranged perpendicularly to the bottom surface of the fixing plate, and one ends of the plurality of arc-shaped vanes are uniformly arranged at a circumference which center is the fixing hole, and a convex direction of the plurality of arc-shaped vanes is the same as a direction of the rotation of the drying impeller.

Preferably, another ends of the plurality of arc-shaped vanes opposite to the fixing hole are protruded from an outer edge of the fixed plate.

Preferably, the drying impeller further comprises a fixing ring, an outer edge of an arc-shaped edge of the plurality of arc-shaped vanes opposite to the fixed plate is fixed to the fixing ring.

Preferably, the roller comprises a clothing access opening provided with a door seal assembly comprising a door seal frame and a flow guide pipe corresponding to the door seal frame, one end of the door seal frame having a sealing window, the flow guide pipe having a first end and an opposing second end; the first end of the flow guide pipe is connected with the air outlet of the drying duct, and the second end of the flow guide pipe is provided inside the door seal frame and an opening of the second end is opposite to the sealing window.

Preferably, the flow guide pipe is provided on top of the door seal frame; the door seal frame is provided with a mounting hole in shape corresponding to a shape of the flow guide pipe, the flow guide pipe passes through the mounting hole and is fixedly connected to the door seal frame.

Preferably, the door seal frame is provided with a penetrating flow guide hole, an outer side opening of the flow guide hole is connected with the drying duct, and the flow guide pipe is fixedly connected to an inner side opening of the flow guide hole.

Preferably, the door seal assembly further comprises an adapter groove fixedly connected to the outer side opening of the flow guide hole, the flow guide hole being connected to the drying duct through the adapter groove, an inner surface of an end of the adapter groove connected to the drying duct is provided with a sealing rib.

The combined washing and drying machine of the present disclosure includes a roller, a condenser, a drying duct, a water inlet and a drainage. Hot and humid air inlet of the condenser is connected with the roller, dry air outlet of the condenser is connected with air inlet of the drying duct, and air outlet of the drying duct is connected with the roller to form a cycle wind path. The condenser inputs condensed water through the water inlet, and discharges the condensed water after heat exchange through the drainage. It is to be understood that the combined washing and drying machine is capable of cleaning clothing and drying clothing, thereby avoiding the need of manually and repeatedly accessing the clothing, and it is thus very convenient. The present disclosure facilitates the cleaning and drying of the clothing and enhances the drying effect through the water inlet in which a plurality of water outlet holes are distributed.

These and other objectives of the present invention will no doubt become obvious to those of ordinary skill in the art after reading the following detailed description of the preferred embodiment that is illustrated in the various figures and drawings.

The realization of the purpose, functional features and advantages of the present disclosure will be further described with reference to the accompanying drawings.

DETAILED DESCRIPTION

The technical solutions described in the embodiments of the present disclosure will now be clearly and completely described in conjunction with the accompanying drawings in the embodiments of the present disclosure. It will be apparent that the described embodiments are merely a part of the embodiments of the present disclosure and are not intended to be exhaustive. All other embodiments obtained by those of ordinary skill in the art without making creative work are within the scope of the present disclosure, based on embodiments in the present disclosure.

It should be noted that all directional indications (such as upper, lower, left, right, front, rear . . . ) in the embodiments of the present disclosure are used only to explain, in a particular gesture (as shown in the accompanying drawings), the relative positional relationship between the components, movement, etc. If the particular gesture changes, the directional indications will change accordingly.

In addition, the description of "first", "second", and the like in the present disclosure is for illustrative purposes only and are not meant to indicate or imply the relative importance of the features or implicitly indicate the number of technical features indicated. Thus, a feature defined by "first", "second", may expressly or implicitly include at least one of the features. In addition, the technical solutions between the various embodiments may be combined with each other, but must be based on the ability of one of ordinary skill in the art to be realized, and the combination of the technical solutions should not be present when the combination of technical solutions is contradictory or impossible to achieve, and are not within the scope of the invention as claimed.

Figure 2:
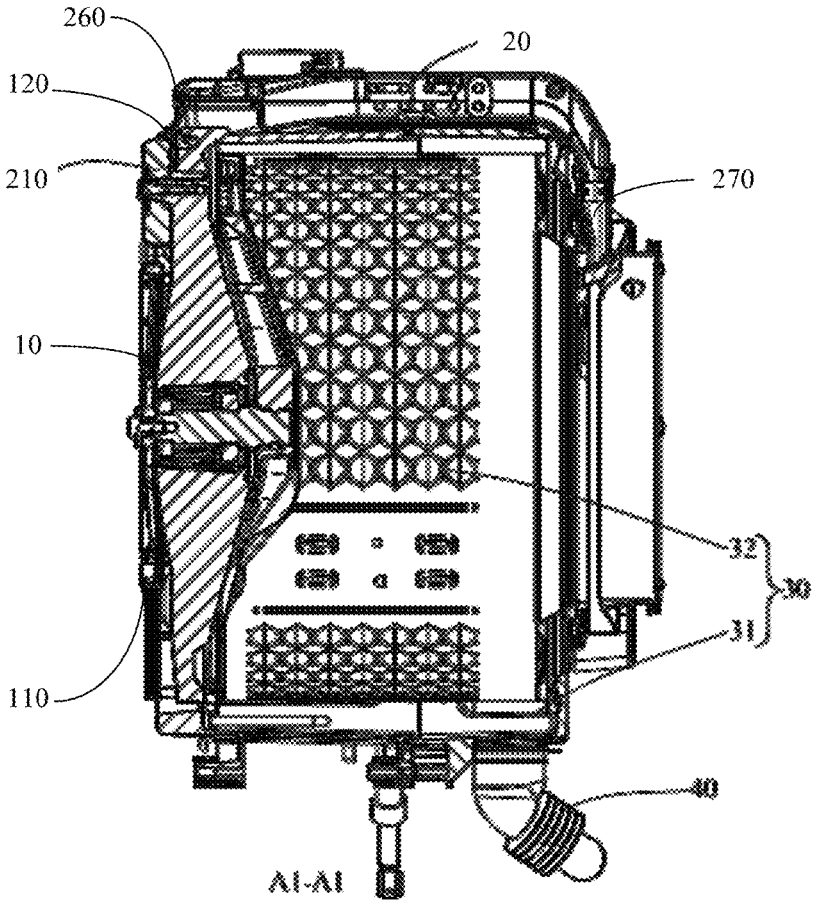
FIG. 2 is a cross-sectional view, taken along line A1-A1, of the combined washing and drying machine shown in FIG. 1*a;*
Figure 3:
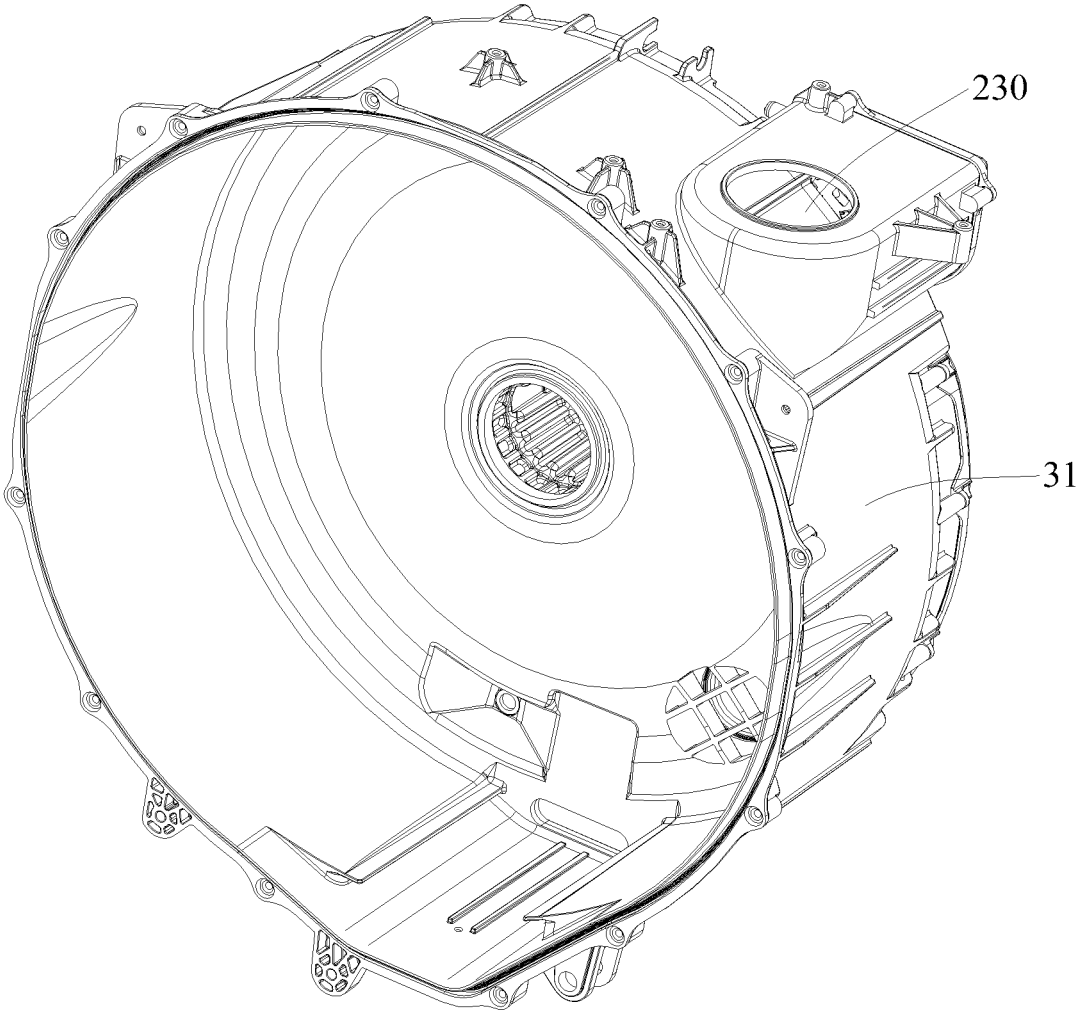
FIG. 3 is a schematic view of the assembly of the shell and air passage of the combined washing and drying machine shown in FIG. 1*a* and FIG. 1*b;*

The present disclosure provides a combined washing and drying machine. Referring to FIGS. 1 to 3, in an embodiment of the present disclosure, the combined washing and drying machine includes a condenser 10, a drying duct 20, a roller 30, a water inlet 50, and a drainage 40.

Hot and humid air inlet 110 of the condenser 10 is connected with the roller 30, dry air outlet 120 of the condenser 10 is connected with air inlet 260 of the drying duct 20, and air outlet 270 of the drying duct 20 is connected with the roller 30 to form a cycle wind path. The condenser 10 inputs condensed water through the water inlet 50, and discharges the condensed water after heat exchange through the drainage 40.

The roller 30 includes a shell 31 and an inner cylinder 32 which is mounted in the shell 31 and is driven to rotate by a motor. The inner cylinder 32 has a clothing access opening which is sealed by a door seal assembly 33. The inner cylinder 32 is formed by enclosing an annular side wall and a rear cover, and the side wall is provided with a plurality of air outlets communicating with the air outlet of the drying duct 20, and the rear cover is provided with a plurality of air outlets communicating with the air outlet of the drying duct 20. However, sizes of the air outlets on the rear cover should be set as small as possible.

When cleaning the clothing, the inner cylinder 32 is driven to rotate by the motor. After the clothing are cleaned, and the drying duct 20 is operated to supply the dried hot air to the roller 30 to dry the clothing. The hot and humid air generated during the drying of the clothing inputs the condenser 10 through the hot and humid air inlet of the condenser 10, and the condenser 10 exchanges the heat with the hot and humid air by the water from the water inlet 50. After the heat exchanges, the hot and humid air is converted into the dried air. The dried air is drawn into and heated by the drying duct 20 and then conveyed to the roller 30 again. Through the above cycle, drying of clothing is achieved.

The combined washing and drying machine of the present disclosure includes a roller 30, a condenser 10, a drying duct 20, a water inlet 50 and a drainage 40. Hot and humid air inlet of the condenser 10 is connected with the roller 30, dry air outlet of the condenser 10 is connected with air inlet of the drying duct 20, and air outlet of the drying duct 20 is connected with the roller 30 to form a cycle wind path. The condenser 10 inputs condensed water through the water inlet 50, and discharges the condensed water after heat exchange through the drainage 40. It is to be understood that the combined washing and drying machine is capable of cleaning clothing and drying clothing, thereby avoiding the need of manually and repeatedly accessing the clothing, and it is thus very convenient. The present disclosure facilitates the cleaning and drying of the clothing.

Referring to FIGS. 3 to 10, in a preferred embodiment of the present disclosure, the condenser 10 includes a condensing plate 11 and a housing 13 disposed on an outer wall of the roller 30 and encloses the outer wall of the roller 30 to form a receiving cavity for receiving the condensing plate 11, and the receiving cavity is connected with the air inlet of the drying duct 20 and the roller 30.

The housing 13 is preferably provided in a semi-encircled manner to enclose the receiving cavity 130 for receiving the condensing plate 11. It will be appreciated that when the number of condensing plates 11 is increased, the space of the receiving cavity 130 is adjusted accordingly.

It is to be noted that the receiving cavity formed by connecting and fixing the housing 13 to the roller 30 is a heat exchange passage including a dry air outlet at the upper end of the roller 30 and a hot and humid air inlet at the lower end thereof. When installed in the heat exchange passage, the water inlet end 11*a* of the condensing plate 11 is connected to the water inlet 50 to input the condensed water, and the water outlet end 11*b* thereof is connected to the drainage 40 to discharge the condensed water after the heat exchange. After installation, the condensing plate 11 divides the heat exchange passage into multiple heat exchange zones.

The condensing plate 11 includes a water inlet end 11*a*, a water outlet end 11*b* opposite to the water inlet end 11*a*, and a flow guide surface for guiding the condensed water from the water inlet end 11*a* to the water outlet end 11*b*. The flow guide surface may be a part of the plate surface of the condensing plate 11 or may be the entire plate surface of the condensing plate 11. Of course, the entire plate surface of the condensing plate 11 is generally provided as the flow guide surface in order to ensure the heat exchange area. Since the condensing plate 11 has two opposing plate surfaces, two flow guide surfaces can be accordingly arranged to increase the flow guide area.

A plurality of first heat exchange portions 101 for slowing down flow rate of the condensed water flowing through the flow guide surface are protruded from the flow guide surface.

In the present embodiment, each first heat exchange portion 101 may be of various shapes such as a plate, a sheet, a ridge, or the like. Regardless of any shapes, the first heat exchange portion 101 should have a flow barrier surface facing the water inlet end 11*a* to block the condensed water inputting the flow guide surface from the water inlet end 11*a,* to slow down the flow rate of the condensed water in order to prolong the time when the condensed water stays to exchange heat, to disperse the water flow so that the condensed water and the hot and humid air fully exchanges the heat, thereby improving heat exchange efficiency. In addition, each first heat exchange portion 101 can slow down the flow rate of the hot and humid air rising from the bottom and disperse it so as to ensure that the hot and humid air is sufficiently heat-exchanged with the condensed water on the condenser 10, and the heat exchange efficiency is also improved. Of course, when the side of the first heat exchange portion 101 facing the water outlet end 11*b* of the condenser 10 is also provided as a surface structure, it is possible to further slow down and disperse the hot and humid air rising from the bottom to make the heat exchange of the hot and humid air more fully and thus greatly improve the heat exchange efficiency, and to make the air into the inner cavity dryer in order to quickly dry clothing.

In a preferred embodiment, the first heat exchange portion 101 is in a form of a plate, one end of the first heat exchange portion 101 is fixed to the condensing plate 11 and the other end opposite to the end is suspended, a plate surface of the first heat exchange portion in the form of the plate faces a direction of the water inlet end 11*a* to slow down the flow rate of the condensed water inputting the flow guide surface from the water inlet end 11*a.*

In a preferred embodiment, the first heat exchange portion 101 and the flow guide surface form an angle which opening is toward the direction of the water inlet end 11*a,* and the angle is greater than or equal to 90 degrees. The first heat exchange portion 101 in such a structure can not only slow down the flow rate of the condensed water, but also ensure that the water flow can flow down and disperse along the flow barrier surface of the first heat exchange portion 101 and sufficiently exchange the heat with the hot and humid air.

In a preferred embodiment, the plate surface of the first heat exchange portion 101 is inclined in the direction of the water inlet end 11*a.* First, it is to be noted that a plate surface of the first heat exchange portion 101 may directly face the direction of the water inlet end 11*a* on the front, or may obliquely face the direction of the water inlet end 11*a,* as in the preferred embodiment. However, using, but not limited to the technical solution of the preferred embodiment, it is possible to change and direct the flow of the condensed water to accommodate the different shapes of the condensing plate 11, such as a curved condensing plate 11, a vertical condensing plate 11, and the like. In addition, the technical solution of the preferred embodiment can avoid concentrated flowing down of the water flow from somewhere.

In a preferred embodiment, the first heat exchange portions 101 on the two flow guide surfaces of the condensing plate 11 are staggered so that the heat exchanging on the two flow guide surfaces of the condensing plate 11 are more uniform. Further, when staggered, the condensing plate 11 can be formed integrally with the sheet metal. Of course, the condensing plate 11 of the present embodiment may be integrally molded by injection molding, and is not limited thereto.

It should be noted that in the above embodiment, the condenser 10 for the combined washing and drying machine may include a condenser plate 11, or a plurality of condenser plates 11. The present disclosure is not limited thereto. In a preferred embodiment, the condenser 10 may include two condensing plates 11, and the two condensing plates 11 are disposed opposite to each other and spaced apart from each other, and the two condensing plates 11 are connected and fixed to each other by a connecting member 12. The purpose of this arrangement is to increase the overall heat exchange area of the condenser 10 to provide sufficient dry air required for drying.

In a preferred embodiment, the housing 13 is fixedly secured to the roller 30 of the combined washing and drying machine by a fixing leg 131. A through hole 132 is provided on the fixing leg 131 for insertion of a screw.

Figure 9A:
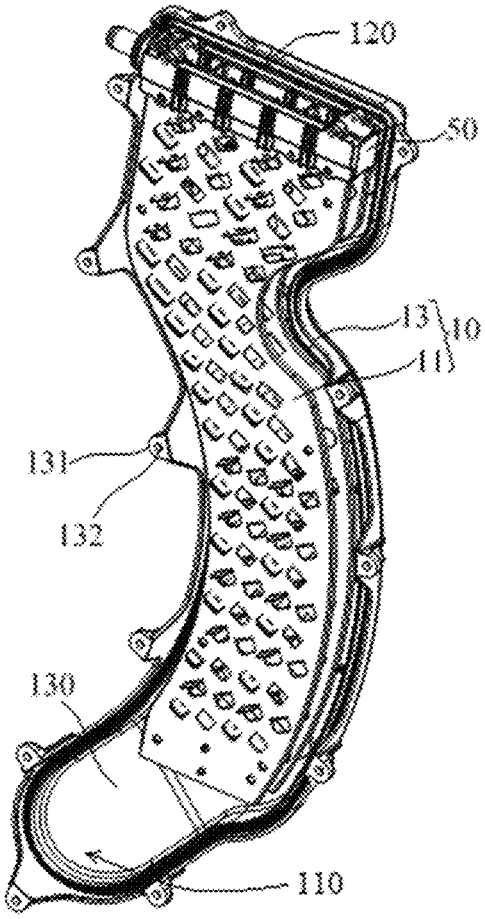
FIG. 9*a* is a schematic view of the assembly of the condenser and the housing for the combined washing and drying machine shown in FIG. 7.
Figure 9B:
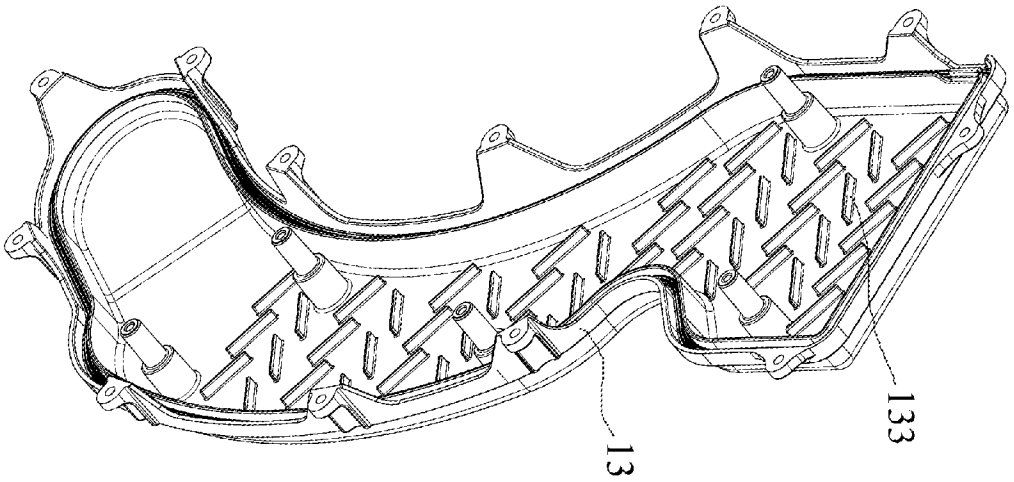
FIG. 9*b* is a schematic view of the housing.
Figure 10:
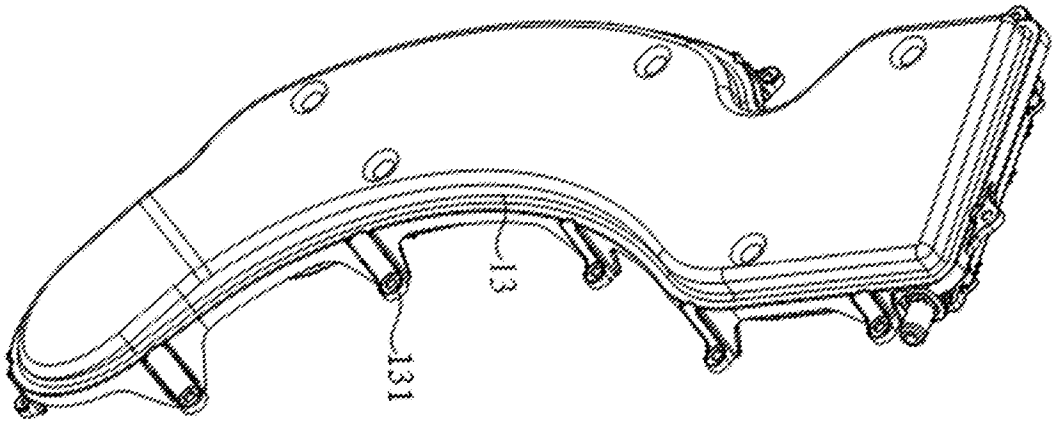
FIG. 10 is another view of FIG. 9*a;*
Figure 11:
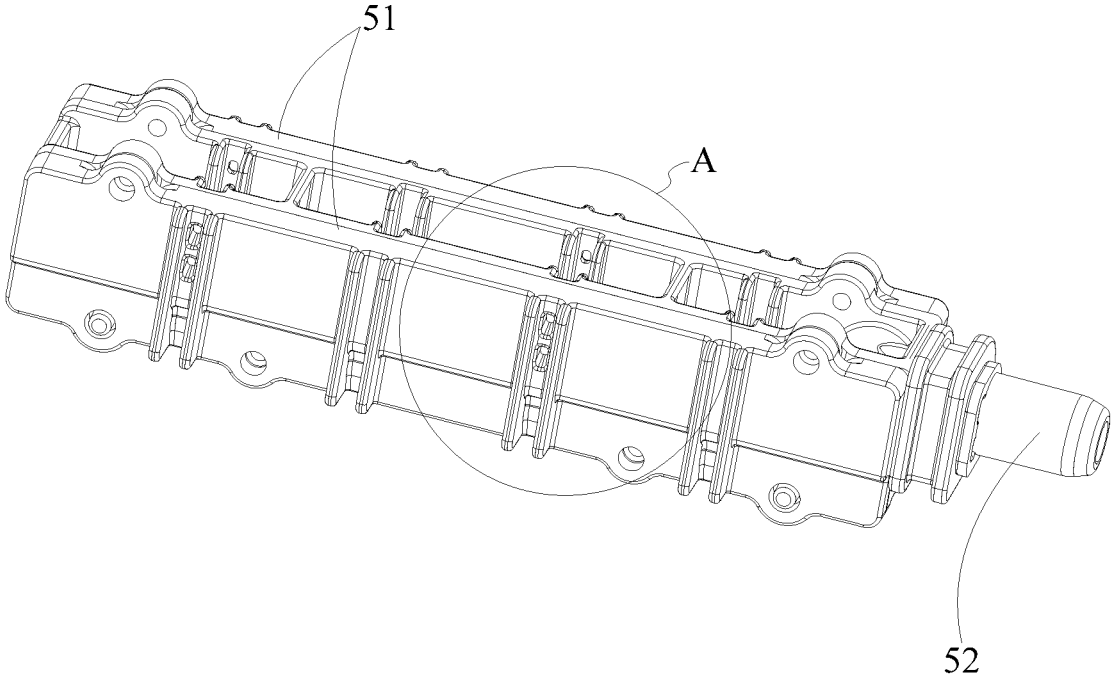
FIG. 11 is a perspective view of the water inlet of the condenser for the combined washing and drying machine according to an embodiment of the present disclosure.

In this embodiment, referring to FIG. 9*b*, FIG. 9*b* is a schematic view of the housing 13, a second heat exchange portion 133 may be provided on one side of the housing 13 facing the condensing plate 11. The structure of the second heat exchange portion 133 is substantially the same as that of the first heat exchange portion and may be achieved referring to the structure of the first heat exchange portion. The repeated description is omitted here.

In this embodiment, the housing 13 is preferably a plastic member and is integrally molded with the second heat exchange portion 133 thereon.

Referring to FIGS. 11 to 17, in a preferred embodiment of the present disclosure, the water inlet 50 includes a bar-shaped container 51 having one opening end and one closed end. The opening end of the bar-shaped container 51 is provided with a water inlet joint 52, and the water flows into an inner cavity 501 of the bar-shaped container 51 through the water inlet joint 52. The bar-shaped container 51 is provided with a mounting portion for matching installation with the condensing plate 11 of the condenser 10. When the bar-shaped container 51 is mounted on the condensing plate 11 of the condenser 10 through the mounting portion, the condensing plate 11 is vertically below the bar-shaped container 51.

The bar-shaped container 51 has a first side and a second side corresponding to the two plate surfaces of the condensing plate 11, and the first side and the second side are respectively provided with a plurality of water outlet holes 502 which are connected to the inner cavity 501 of the bar-shaped container 51 and are spaced apart along a direction from the opening end of the bar-shaped container 51 to the closed end.

When the machine is assembled, the water inlet joint 52 is used to connect a water inlet valve to introduce the condensed water into the inner cavity 501 of the bar-shaped container 51. When the water flow reaches the water level of the respective water outlet holes 502, the condensed water flows out through the respective water outlet holes 502 so as to evenly spread onto the two plate surfaces of the condensing plate 11. Therefore, not only the heat exchange area of the condensed water and the condenser 10 is large, but also the heat exchange is more sufficient, thereby improving the utilization of the condensed water and the heat exchange efficiency of the condenser 10. In addition, due to sufficient heat exchange, air after the heat exchange is dried to a higher extent. This makes the drying efficiency higher, and greatly saves energy.

It should be noted that the number of the bar-shaped containers 51 is set in accordance with that of the condensing plates 11 of the condenser 10. When the number of the bar-shaped containers 51 is more than one, adaptive settings can be made with reference to the following preferred embodiments. In the preferred embodiment, the number of the stripe-shaped containers 51 is two and parallel to each other, and the opening ends of the two bar-shaped containers 51 are connected with the water inlet joint 52, respectively, and the two bar-shaped containers 51 share the water inlet joint 52 for supply of the water, thereby reducing the volume of the structure.

Figure 14:
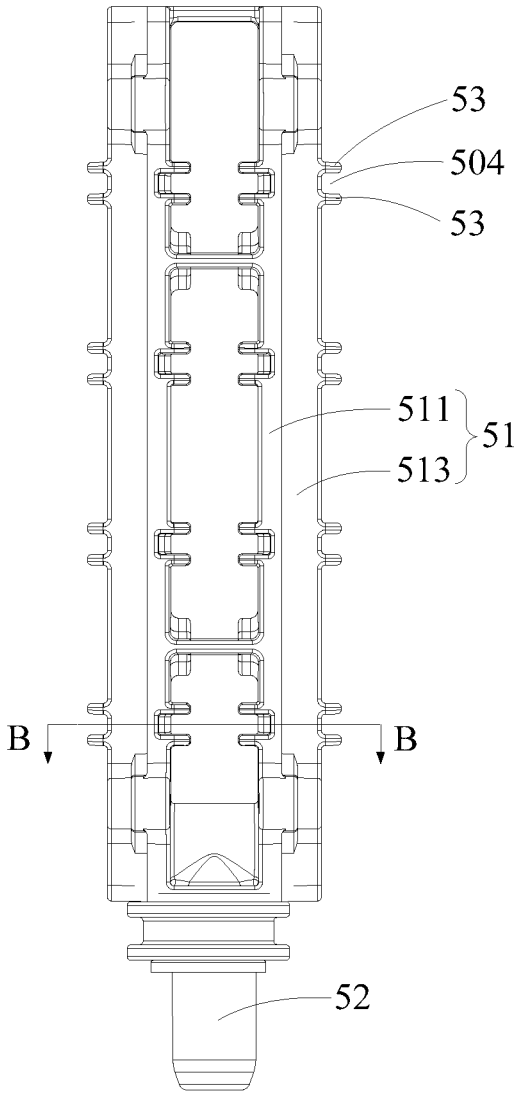
FIG. 14 is a top view of the water inlet of the condenser for the combined washing and drying machine shown in FIG. 11.
Figure 15:
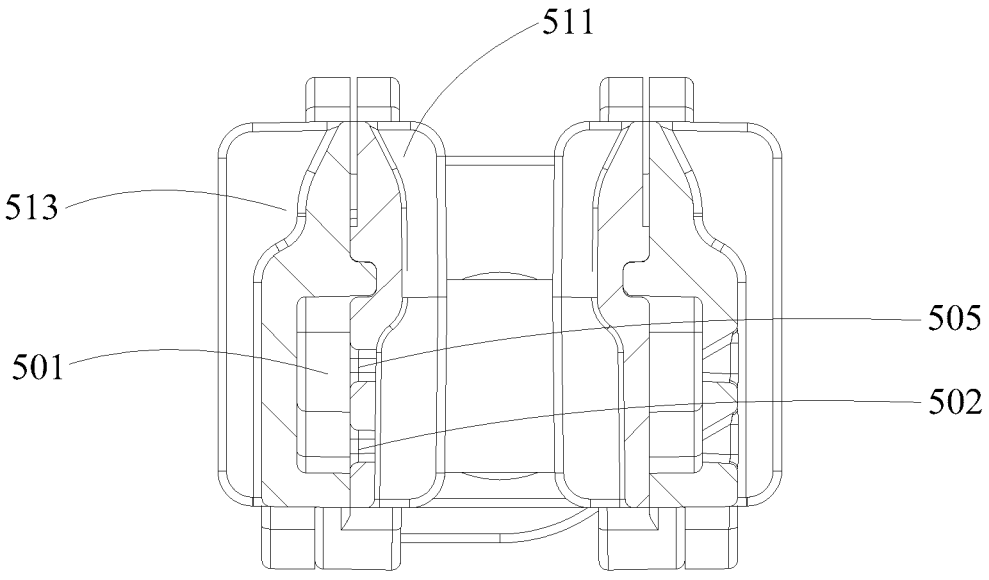
FIG. 15 is a cross-sectional view, taken along line B-B, of FIG. 14.
Figure 16:
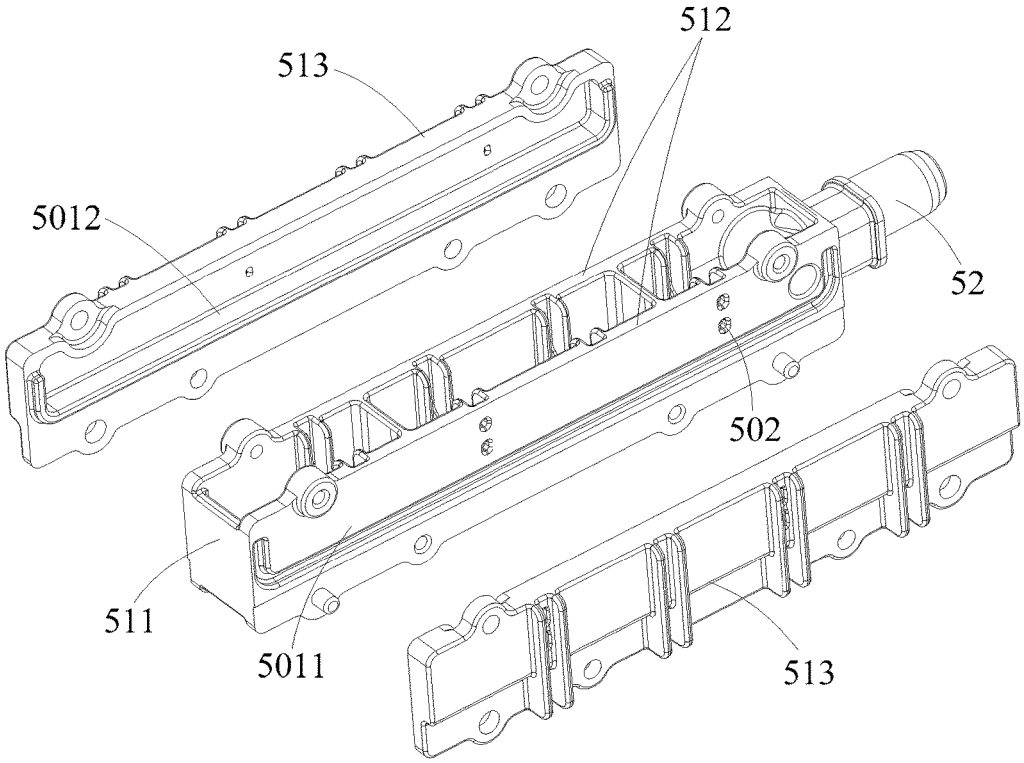
FIG. 16 is an exploded view of the condenser for the combined washing and drying machine shown in FIG. 11.
Figure 17:
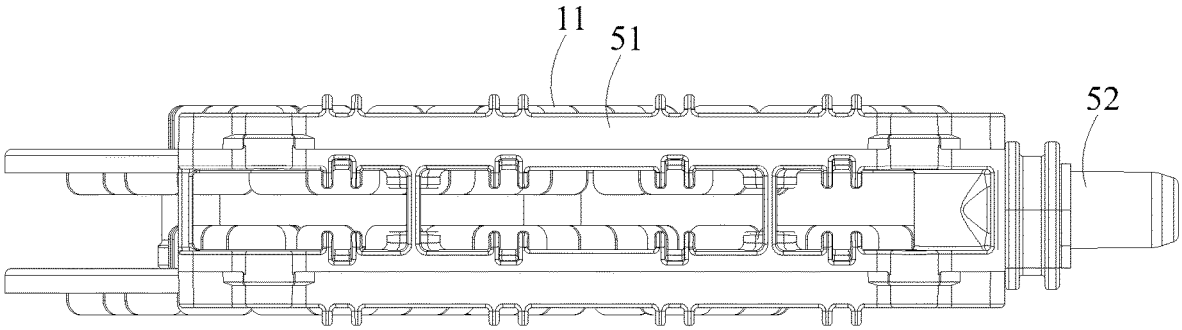
FIG. 17 is a schematic view of the assembly of the water inlet and the condenser for the combined washing and drying machine shown in FIG. 11.

Preferably, referring to FIGS. 14 to 16, the bar-shaped container 51 includes a main body 511 extending in middle of the container, and one end of the main body 511 is provided with the water inlet joint 52. The main body 511 includes two mounting walls 512 arranged parallel and opposite to each other, and each mounting walls 512 has a first water tank 5011 communicating with the water inlet joint 52. First plates 513 are respectively adhered to the two mounting walls 512 and provided with a second water tank 5012 in a position corresponding to the first water tank 5011, and the first water tank 5011 and the second water tank 5012 constitute the inner cavity 501 of the bar-shaped container 51. A plurality of water outlet holes 502 are provided in the two mounting walls 512, and a plurality of water outlet holes 502 are provided in the first plate 513. The mounting portions, which are the structure of thru-holes 503, are provided at the lower ends of the two mounting walls 512 and the two first plates 513. The condensing plate 11 correspondingly has mounting holes. In addition, a slot for insertion of the condensing plate 11 may be provided between the lower end of the mounting wall 512 and the lower end of the first plate 513. When assembling, the condensing plate 11 is inserted into the slot and then held through the mounting wall 512 and the first plate 513. After that, the bolt passes through the thru-holes 503 and the mounting hole in each member, and the nut is tightened by tightening the nut on the bolt so that the condensing plate 11 is connected and fixed to the bar-shaped container 51. This structure of the present embodiment is firm, easy to form and mount.

It is to be noted that the number of the water outlet holes 502 on the first side and the second side of the bar-shaped container 51 may be the same or different. In a preferred embodiment, the number of the water outlet holes 502 on the first side and the second side are the same, and a plurality of the water outlet holes 502 on the first side and a plurality of the water outlet holes 502 on the second side are spaced apart from each other in the direction from the opening end of the inner cavity 501 to the closed end of the inner cavity 501. In this structure, the positions on the two plate surfaces of the condensing plate 11 onto which the condensed water can be dropped are not in the same area of the condensing plate 11, thereby improving the effect of heat exchange of the condensed water through the condensing plate 11. For example, the bar-shaped container 51 shown in FIG. 14 has two water outlet holes 502 on the first side and the second side, respectively.

Further, in order for the respective water outlet holes to simultaneously discharge the water and uniformly and sufficiently exchange the heat, the plurality of water outlet holes 502 on the first side of the bar-shaped container 51 are on the same horizontal line and/or the plurality of water outlet holes 502 on the second side are on the same horizontal line, and more preferably, the plurality of water outlet holes 502 on the first side of the bar-shaped container 51 and the plurality of water outlet holes 502 on the second side are on the same horizontal plane to ensure simultaneous dropping of the condensed water onto the two plate surfaces of the condensing plate 11 so that the heat exchange effect is better.

Further, in order to allow more sufficient heat exchange of the condensed water through the condensing plate 11, each water outlet hole 502 is an elliptical hole or a waist-shaped hole having an elliptical long axis having a diameter of about 1.5 mm and an elliptical minor axis having a diameter of about 1 mm. Shapes and sizes of the water outlet holes 502 can cause the condensed water to flow out and drop on the condensing plate 11 in the form of water droplets, thereby improving the utilization rate of the condensed water.

Figure 4:
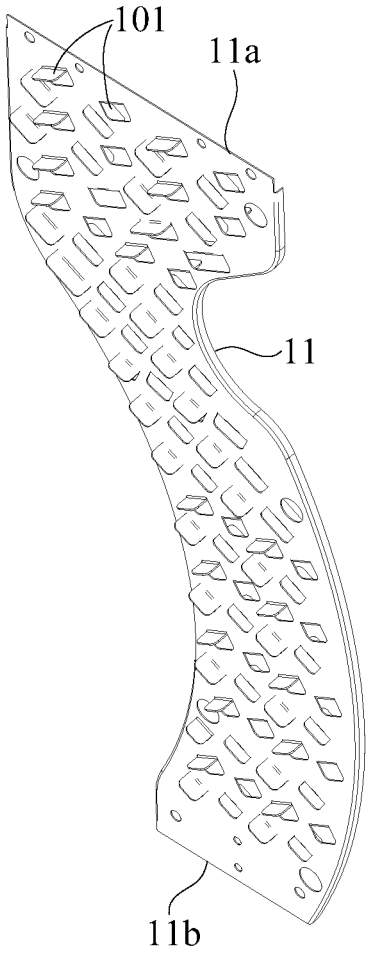
FIG. 4 is a perspective view of a condenser for the combined washing and drying machine according to an embodiment of the present disclosure.
Figure 5:
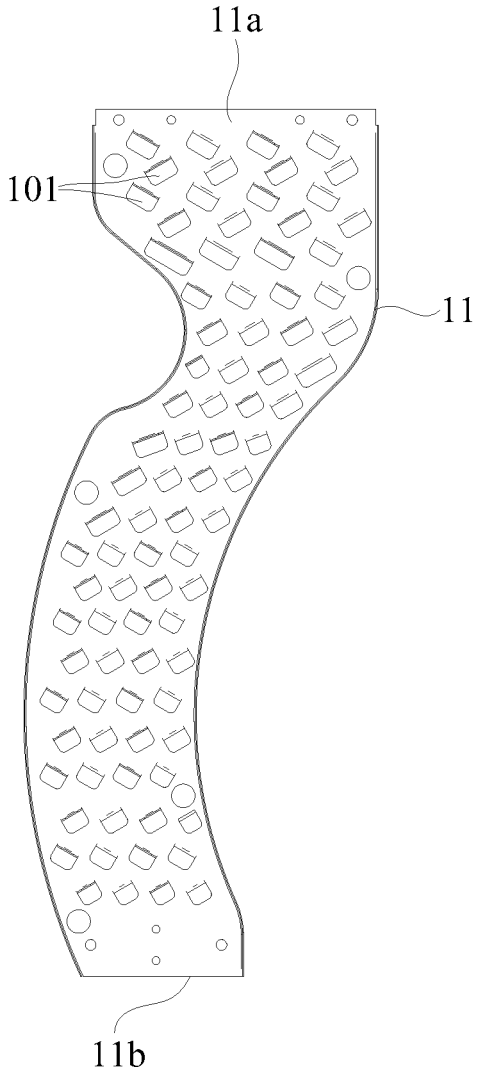
FIG. 5 is a front view of the condenser for the combined washing and drying machine shown in FIG. 4.
Figure 6:
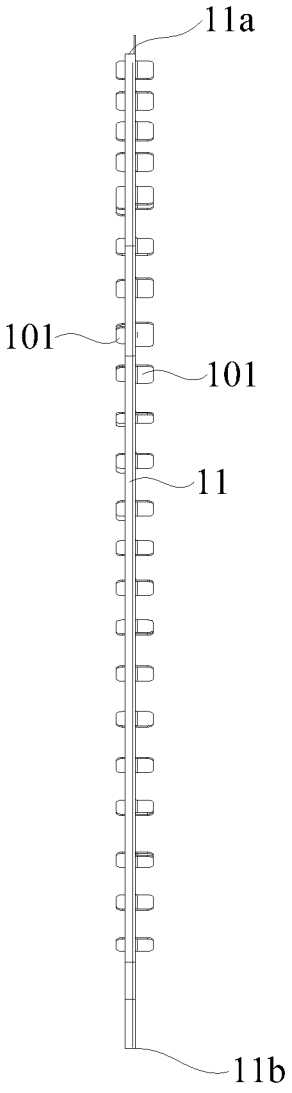
FIG. 6 is a side view of the condenser for the combined washing and drying machine shown in FIG. 5.
Figure 7:
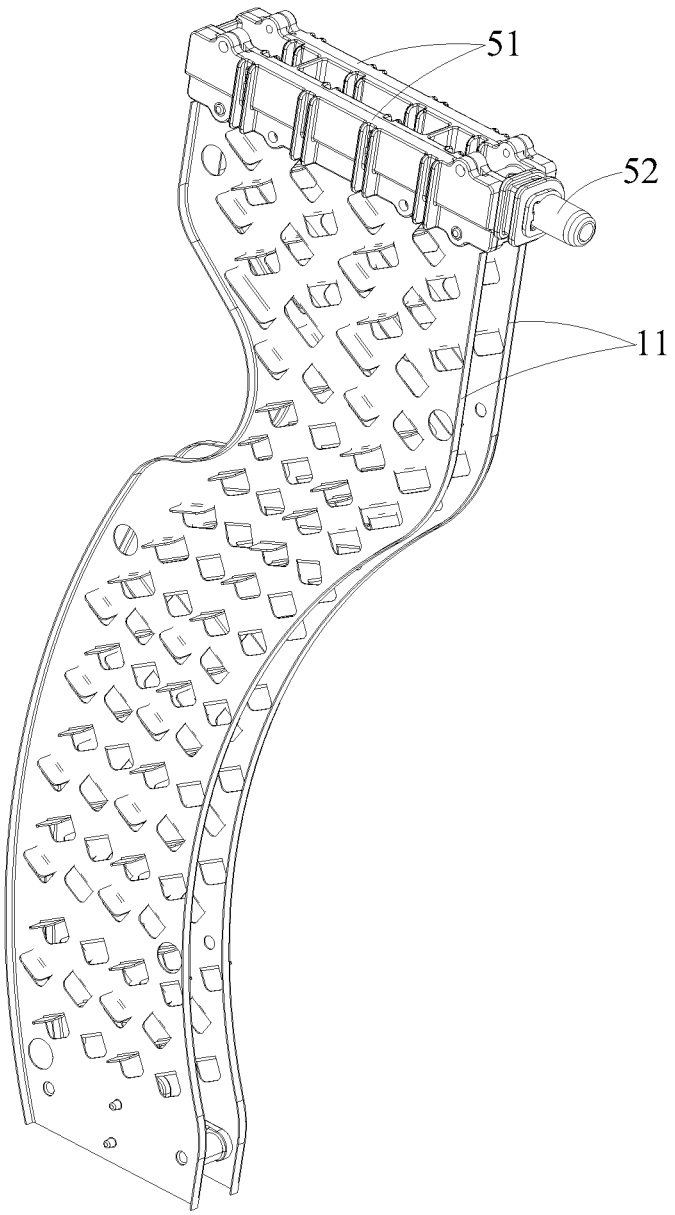
FIG. 7 is a schematic view of the assembly of two condensers and water inlet for the combined washing and drying machine shown in FIG. 1*a* and FIG. 1*b;*
Figure 8:
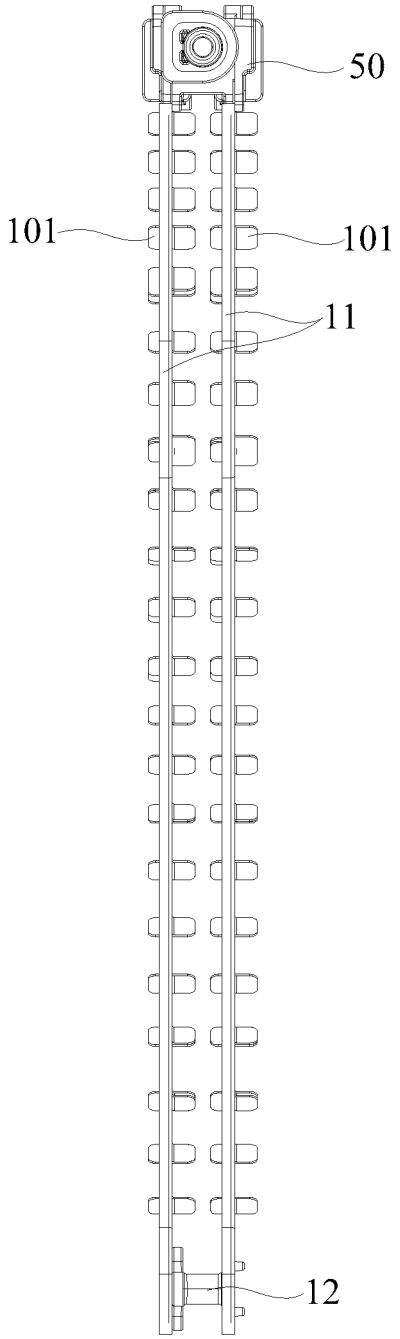
FIG. 8 is another view of FIG. 7.

Further, in conjunction with FIGS. 2 and 4, in the above embodiments, the position of each of the water outlet holes 502 of the bar-shaped container 51 is provided with a flow guide groove 504 for guiding the water flow of the water outlet holes 502 to the condensing plate 11. The flow guide groove 504 causes the water flowing out of the water outlet holes 502 to flow smoothly to the predetermined position of the condensing plate 11.

Figure 12:
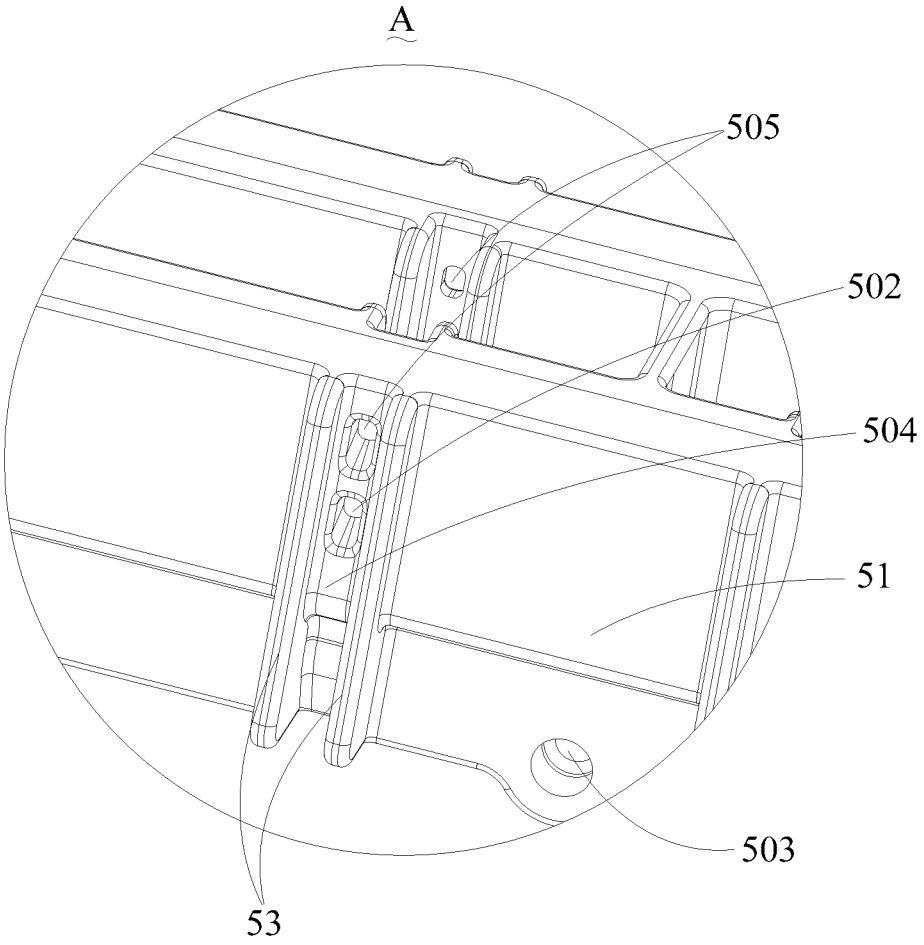
FIG. 12 is an enlarged view of a portion A in the condenser for the combined washing and drying machine shown in FIG. 11.

In this embodiment, the flow guide groove 504 may be formed by recesses in the outer wall of the bar-shaped container 51, or may be implemented as shown in the structure shown in FIG. 12, and in particular, the position of each of the water outlet holes 502 is provided with two baffles 53 in the vertical direction, and the flow guide groove 504 is formed between the two baffles 53.

It is to be noted that in the embodiment having the first plate 513, the flow guide groove 504 is provided on the side of the first plate 513 facing away from the main body 511.

Figure 13:
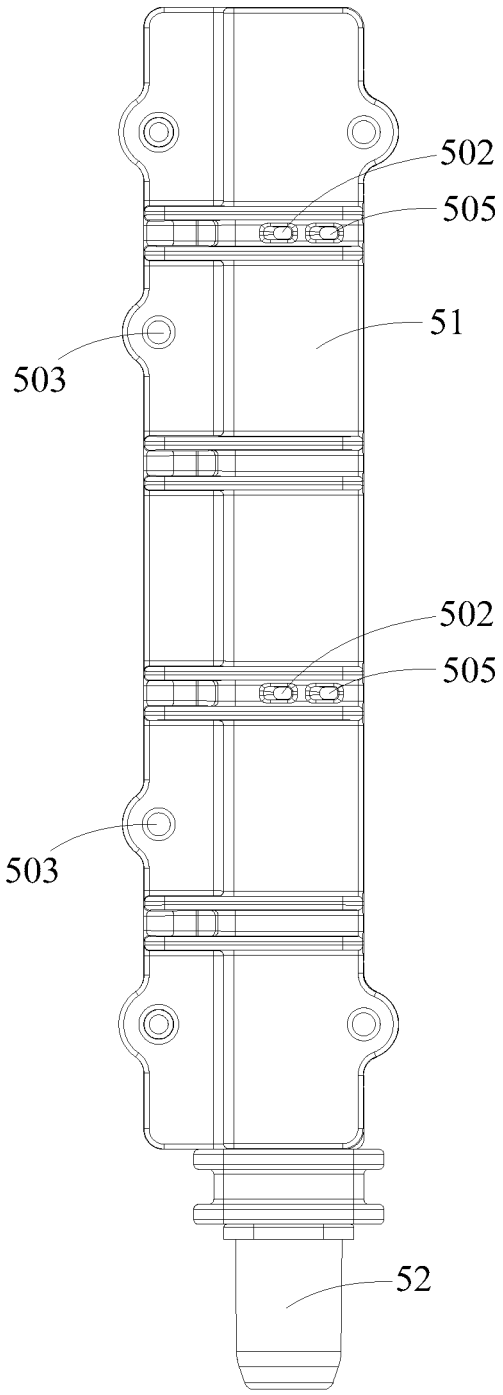
FIG. 13 is a side view of the water inlet of the condenser for the combined washing and drying machine shown in FIG. 11.

Further, in conjunction with FIGS. 12 and 13, in order to avoid excessive water storage in the inner cavity 501 of the bar-shaped container 51, the first side and/or the second side are provided with overflow holes 505, a distance between the overflow hole 505 and a corresponding location on bottom of the inner cavity 501 of the bar-shape container 51 is greater than a distance between the water outlet hole 502 and a corresponding location on bottom of the inner cavity 501 of the bar-shape container 51. It will be appreciated that excess condensed water can be quickly drained through the overflow hole 505 if the condensed water is too much when the combined washing and drying machine is working. The size of the overflow hole 505 may coincide with that of the water outlet hole 502.

It should be noted that the overflow hole 505 may be provided in the guide groove 504.

Figure 18:
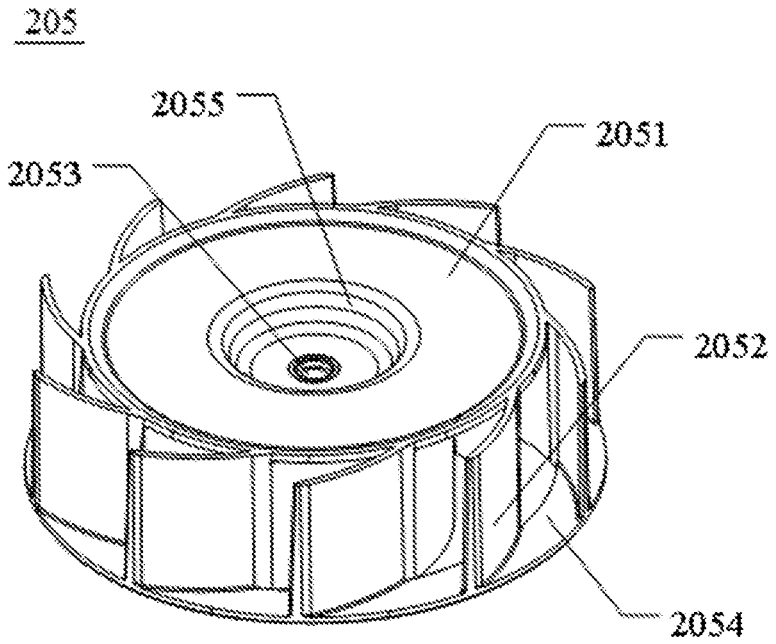
FIG. 18 is a schematic view of the structure of a drying impeller according to an embodiment of the present disclosure.
Figure 19:
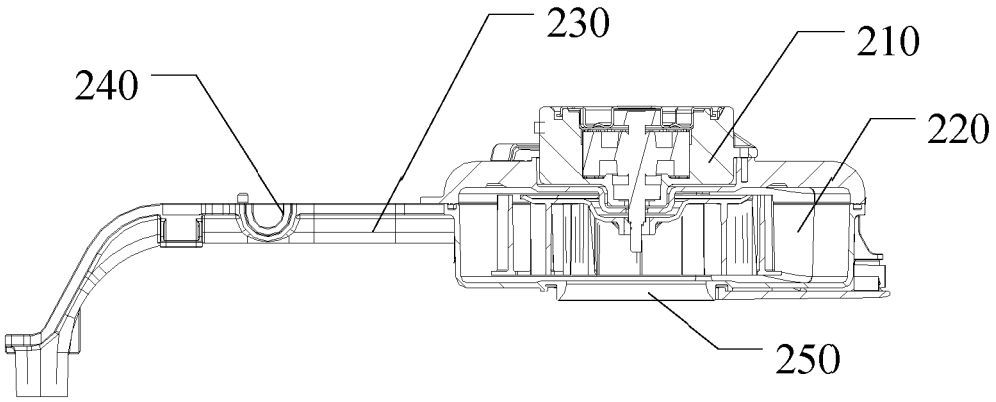
FIG. 19 is a half-sectional view of the structure of a drying duct according to an embodiment of the present disclosure.

Referring to FIGS. 18 and 19, in a preferred embodiment of the present disclosure, the above-described drying duct 20 includes a drying impeller 205, an air passage 230, a turbine cavity 220, a heater 240, and a drying motor 210 for driving rotation of the drying impeller 205.

The drying impeller 205 includes a fixing plate 2051 and a plurality of arc-shaped vanes 2052. The fixing plate 2051 is generally circular and a middle of the fixing plate is provided with a fixing hole 2053 connected to a rotation shaft of the drying motor 210. A arc-shaped edge of the plurality of arc-shaped vanes 2052 is fixed to a bottom surface of the fixing plate 2051, and the arc-shaped vanes 2052 are arranged perpendicularly to the bottom surface of the fixing plate, and one end of the plurality of arc-shaped vanes is uniformly arranged at a circumference which center is the fixing hole 2053, and outer arc surfaces of the arc-shaped vanes 2052 face the direction of rotation of the drying impeller 205, i.e., a convex direction of the arc-shaped vanes is the same as a direction of the rotation of the drying impeller.

The drying impeller 205 mainly sucks air from the bottom surface of the fixing plate 2051 and ejects the air from the gap between the vanes. In the drying impeller 205 of the present embodiment, the protruded direction of the arc-shaped vanes 2052 is the same as the rotational direction of the drying impeller 205. The air inputting the bottom surface of the fixed plate 2051 accelerates out along the inner arc surface of the arc-shaped vanes 2052, thereby greatly improving the air outlet speed, and thus increasing the air inlet volume and rapidly improving the air pressure. This facilitates to improve the drying capacity of the combined washing and drying machine.

The drying impeller 205 of the present embodiment can meet the requirements for normal operation under high rotational speed and high pressure conditions. The start-up torque required at the low rotational speed is low. This facilitates the start-up of the drying motor 210. However, as the rotational speed is increased, the boosting capability of the drying impeller 205 is rapidly increased, particularly at high rotational speeds (4500 rpm or more). The drying impeller 205 of this embodiment can produce a particularly high air pressure, even the condensed water in the condenser 10 is drawn into the drying duct 20, and heated by the heater to form steam, and the steam is rapidly discharged to the clothing in the roller, thereby achieving the function of steam ironing. At the same time, the drying impeller 205 of this embodiment is more stable at higher rotational speed and the performance is more stable and reliable.

However, as the speed increases, the boosting capacity increases rapidly, especially at high rotational speeds (above 4500 rpm), a backward fan can produce a particularly high air pressure, and even the condensed water in the condenser 10 can be drawn in, And in the high speed, the backward fan works more stable, and its intensity is more reliable.

The rotation shaft of the drying motor 210 is fixedly connected to the fixing hole 2053 of the drying impeller 205, and the drying impeller 205 is fixedly arranged in the turbine cavity 220, and the air passage 230 communicates with the turbine cavity 220, and the position where the bottom of the turbine cavity 220 corresponds to the drying impeller 205 is provided with an air inlet.

The drying impeller 205 is rotated by the driving of the drying motor 210 and the air is drawn in from the air inlet at the bottom of the turbine cavity 220. The air accelerates into the turbine cavity 220 along the inner arc surface of the arc-shaped vanes 2052, then rotates in high speed to form turbulence by the driving of the drying impeller 205, and finally flows into the air passage 230 through the communication port of the turbine cavity 220 and the air passage 230. The air in the air passage 230 is heated by the heater 240 to become a high-temperature drying air flow, and inputs the inner cylinder 32 of the combined washing and drying machine under the guidance of the air passage 230, and then the clothing placed in the inner cylinder 32 is dried and heated by the high-temperature drying air flow.

Preferably, the other end of the arc-shaped vanes 2052 opposite to the fixing hole 2053 protrudes from the outer edge of the fixing plate 2051.

When the arc-shaped vanes 2052 are fixed to the bottom surface of the fixing plate 2051, one end thereof is fixed to the circumference with the fixing hole 2053 as the center, and the other end thereof may be provided on the bottom surface of the fixing plate 2051 and protrude from the outer edge of the fixing plate 2051. When the outer edge of the arc-shaped vanes 2052 protrudes from the outer edge of the fixing plate 2051 and is close to the outer wall of the cavity for fixing the drying impeller 205, the air accelerating out from the inner arc surface of the arc-shaped vanes 2052 forms turbulence, thereby further increasing the air speed and the air pressure and increasing the air inlet volume.

Preferably, the drying impeller 205 in this embodiment also includes a fixing ring 2054. Another arc of the arc-shaped vanes opposite to the fixing plate 2051 is fixedly connected to the fixing ring 2054.

In this embodiment, another arc of the arc-shaped vanes opposite to the fixing plate 2051 is fixedly connected to the fixing ring 2054 to increase the bearing strength and the fixing effect of the drying impeller 205, and avoid that high pressing force by high rotation speed causes the arc-shaped vanes 2052 to be disengaged from the fixing plate.

Further, the fixing ring 2054 is fixedly connected to the outer edge of the arc-shaped vanes 2052.

When the fixed connection position between the fixed ring 2054 and the arc-shaped vanes 2052 is in the outer edge of the arc-shaped blade 2052, the fixing effect is preferable.

It is preferable that the middle of the fixing plate 2051 is recessed toward the bottom of the fixing plate 2051 to form a fitting groove 2055, and the fitting groove 2055 serves as a fixed position of the drying impeller 205 and the rotation shaft of the drying motor 210 for driving the rotation of drying impeller 205. The recessed fitting groove 2055 facilitates to improve the fixing effect between the rotation shaft and the fixing plate 2051, and also facilitates the detachment and maintenance between the drying impeller 205 and the drying motor 210.

Preferably, the number of arc-shaped vanes 2052 fixed to the bottom surface of the fixing plate 2051 in the present disclosure is 10.

The number of the arc-shaped vanes 2052 fixed to the bottom surface of the fixing plate 2051 is set according to the actual situation. In this embodiment, it is preferable that the number of the arc-shaped vanes 2052 is 10. This embodiment has large air outlet volume and can increase the pressure quickly.

Preferably, the drying motor 210 in the above-described embodiment is a variable frequency motor. The rotational speed of the drying impeller 205 can be quickly and easily controlled by using a variable frequency motor, and the air speed and the quantity of the drying air flow inputting the combined washing and drying machine can further be controlled. When the clothing in the inner cylinder 32 is small, the air inlet volume of the drying air flow is little. When the clothing in the inner cylinder 32 is large, the air speed and air inlet volume of the drying air flow inputting the combined washing and drying machine is increased, thereby improving the efficiency of the use of the power.

Preferably, the air passage 230 is arranged in a flat pipe.

The shape of the air passage 230 may be selected depending on the actual use and the use environment. In this embodiment, the air passage 230 is arranged in a flat pipe. The flat tubular air passage 230 is easier for mounting than the conventional circular pipe and does not affect the overall appearance of the combined washing and drying machine. The flat tubular air passage 230 can also increase the air volume passing therethrough to a certain extent, and further improve the drying effect of the combined washing and drying machine.

The heater 240 in the air passage 230 may preferably be a conventional heat-pipe-type heat generator, and the heater 240 is provided in the air passage 230 in the form of S-shaped, and the S-shaped arrangement greatly increases the contact area with the air flow in the air passage. Which is beneficial to improve heating efficiency of the air flow.

Figure 20:
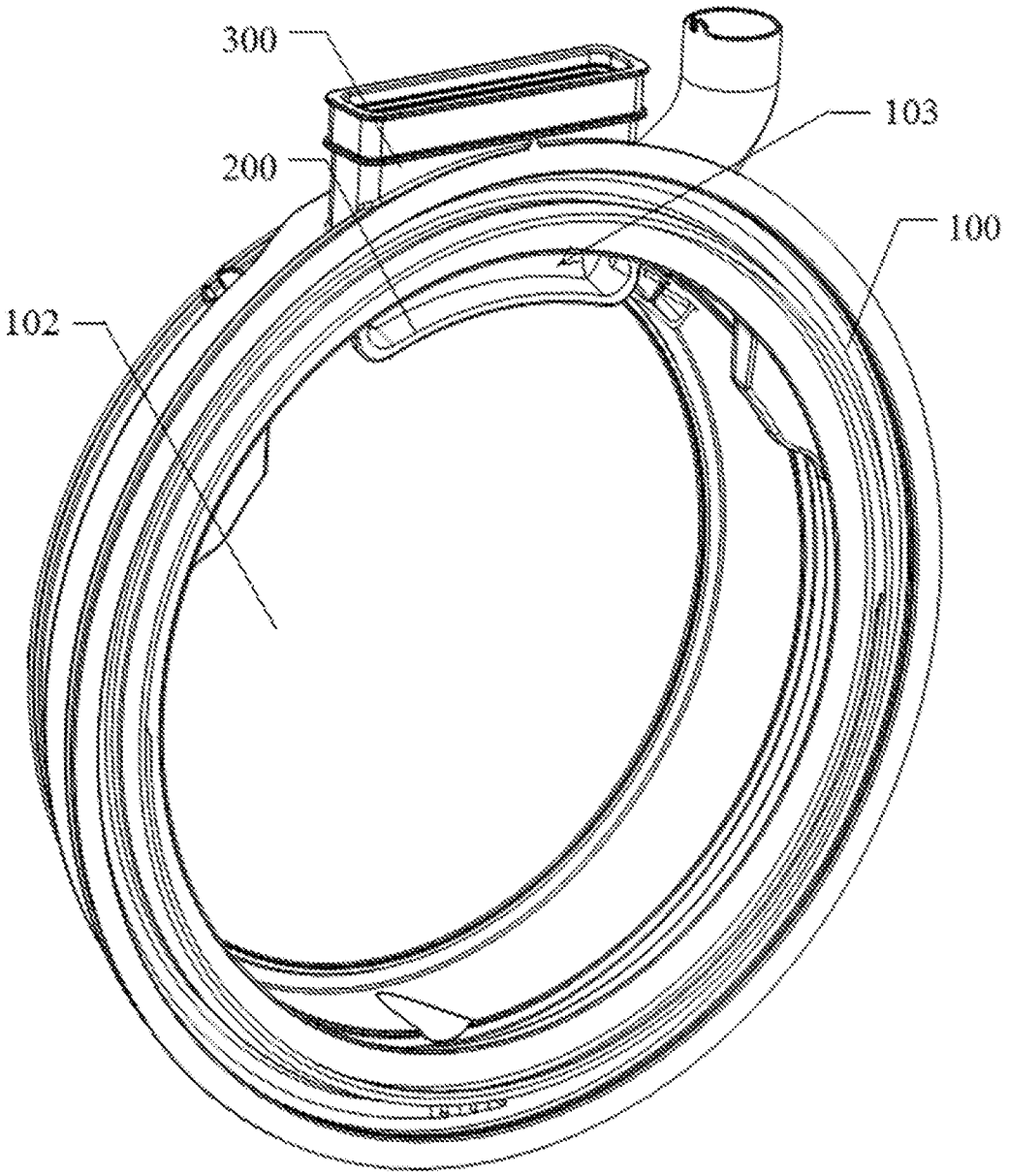
FIG. 20 is a schematic view of a door seal assembly according to an embodiment of the present disclosure.
Figure 21:
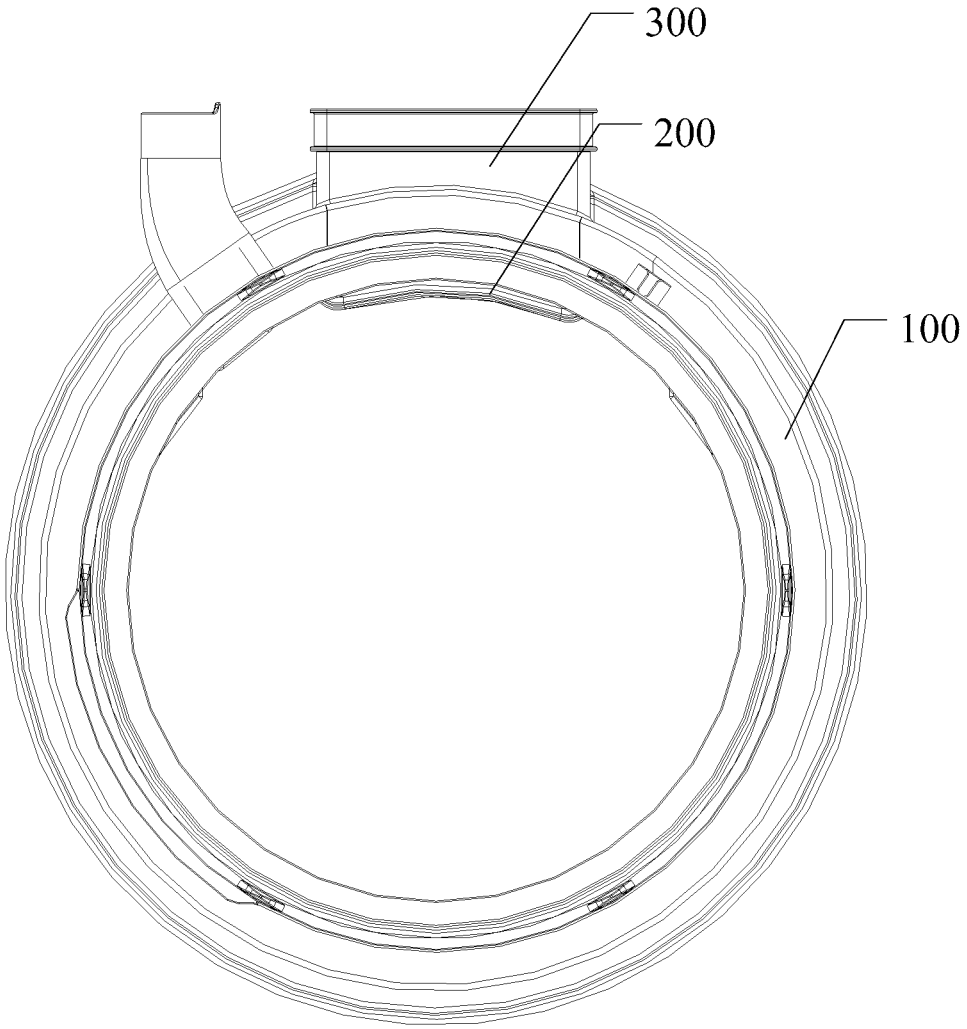
FIG. 21 is a front view of the door seal assembly shown in FIG. 20.
Figure 22:
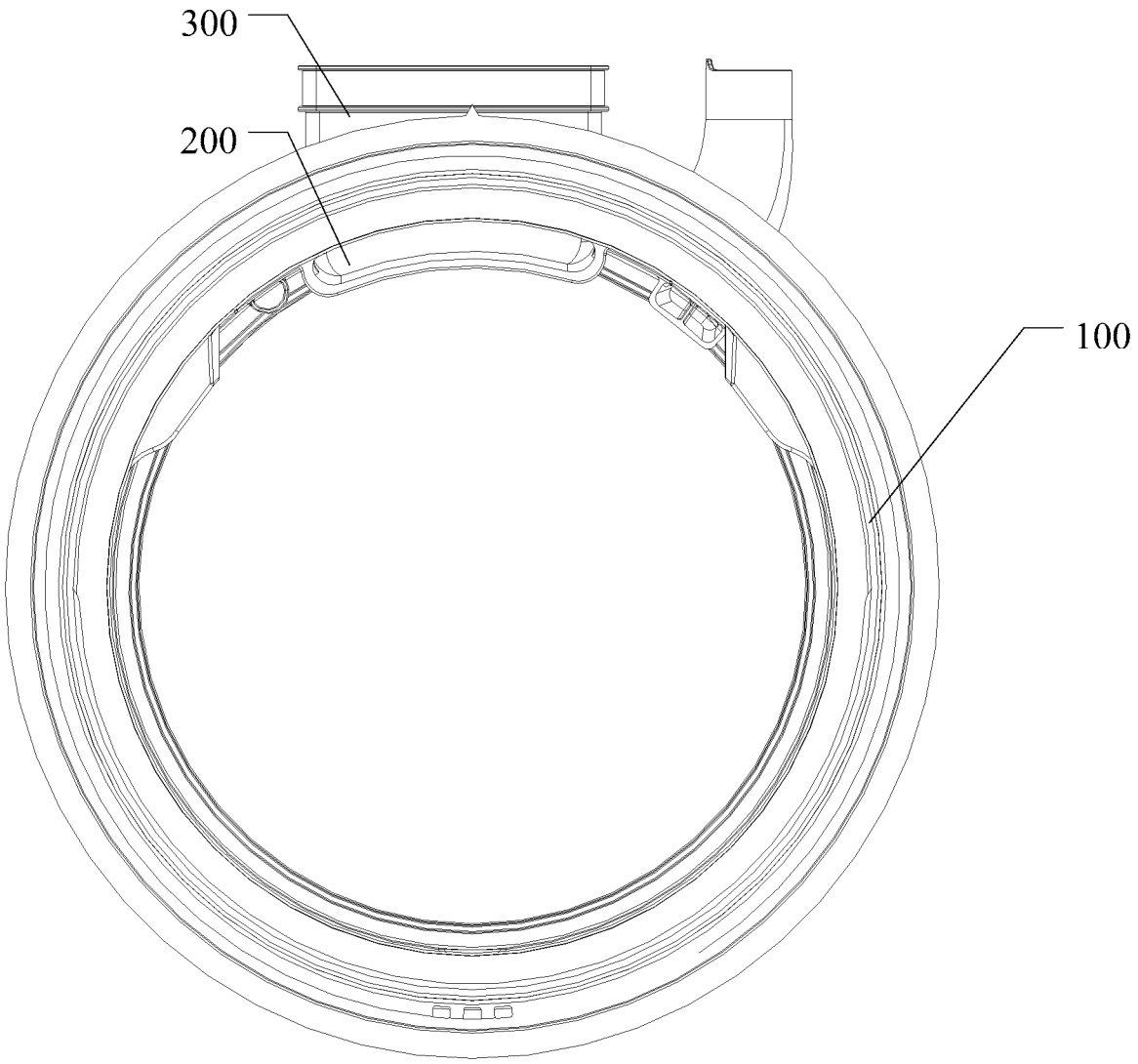
FIG. 22 is a rear view of the door seal assembly shown in FIG. 20.

Referring to FIGS. 20 to 22, in a preferred embodiment of the present disclosure, the door seal assembly 33 includes a door seal frame 100 adapted to the shape of the inner cylinder 32 of the roller 30 and a plurality of flow guide pipes 200 corresponding to the door seal frame 100. One end face of the door seal frame 100 is provided with a sealing window 102. The user can observe the operation condition inside the combined washing and drying machine through the sealing window 102. Each flow guide pipe 200 has a first end and an opposing second end; the first end of the flow guide pipe is connected with the drying duct 20 of the combined washing and drying machine, and the second end of the flow guide pipe is provided inside the combined washing and drying machine and the opening thereof is opposite to the seal window of the door seal frame 100. The dry and hot air is introduced into the flow guide pipe 200 from the first end thereof and then directly into the inner cylinder 32 via the second end under the guidance of the flow guide pipe 200, and the clothing in the inner cylinder 32 is directly dried and heated.

In this embodiment, due to the directional guidance of the flow guide pipe 200, it avoids scatter of the dry and hot air when the dry and hot air inputs the combined washing and drying machine, resulting in a decrease in the drying efficiency without affecting the normal sealing performance of the door seal frame 100. In addition, the embodiment also prevents a portion of the scattered drying hot air from directly inputting the gap between the outer cylinder of the combined washing and drying machine and the inner cylinder 32, and then inputting a drawer box through the bellows in the gap and communicating with the drawer box, which causes temperature in the drawer box is too high, and the user who opens the drawer box may lead to burns and thus there are safety risks.

Preferably, the openings at the first end and the second end of the flow guide pipe 200 are waist-shaped openings.

The shape of the openings of the first end and the second end of the flow guide pipe 200 may be selected according to the actual situation, such as a conventional round pipe shape or other shapes. In this embodiment, the openings of the air inlet 250 and the air outlet are preferably waist-shaped openings. The waist-shaped openings of the air inlet and the air outlet are provided to improve the passing efficiency of the dry and hot air and are more easily fixed to the door frame 100.

Preferably, the flow guide pipe 200 is disposed at the top of the door seal frame.

The conventional combined washing and drying machine is usually a roller-type one, and the door seal frame 100 matching to the machine is generally in the form of a circular shape. The position of the flow guide pipe 200 can be set according to actual needs. On the one hand, it is necessary to consider the position of the drying duct 20. On the other hand, it is necessary to facilitate the arrangement of the flow guide pipe 200. Based on overall consideration of the above-described factors, it is preferred to provide the flow guide pipe 200 at the top of the door seal frame 100, and the drying duct 20 of the combined washing and drying machine is provided at the top of the machine. The door seal assembly 33 of this embodiment is more convenient to install.

In the present embodiment, the flow guide pipe 200 may be correspondingly attached to the door seal frame 100 and fixed to the side edge of the door seal frame 100, and may also pass through door seal frame 100 so as to be fixed to the door seal frame 100. In either case, the second end of the flow guide pipe 200 is disposed inside the door seal frame 100 and toward the inner cylinder 32 of the combined washing and drying machine and the first end thereof serves as an air inlet for the dry and hot air.

Specifically, the door sealing frame 100 is provided with a through mounting hole 103, and the shape of the mounting hole 103 corresponds to that of the flow guide pipe 200, and the flow guide pipe 200 passes through the mounting hole 103 to be fixedly connected to the door seal frame 100.

The mounting hole 103 in this embodiment is not used as a channel for the dry and hot air and only serves as a fixing hole of the flow guide pipe 200. The first end of the flow guide pipe 200 passes through the mounting hole 103 and is exposed to the outside of the door seal frame 100 to form an air inlet connected to the drying duct 20, and the second end of the flow guide pipe 200 is provided towards the inner cylinder 32 of the combined washing and drying machine. The flow guide pipe 200 maybe stuck in the mounting hole 103 or may be relatively fixed to the door seal frame 100 by using of screws, bonding, welding or the like. The door seal assembly 33 of this embodiment is excellent in air tightness, convenient in assembling, relatively low in processing difficulty and easy to install.

Further, the central axis of the first end of the flow guide pipe 200 is disposed at an angle of 90° relative to the central axis of the first end of the flow guide pipe 200, i.e., the flow guide pipe 200 is sufficiently formed in an L-shape.

The two ends of the flow guide pipe 200 may be provided at an arbitrary angle so as to ensure that when the flow guide pipe 200 is relatively fixed to the door seal frame 100, the second end thereof is directed toward the inner cylinder 32 of the combined washing and drying machine. In this embodiment, the central axis of the first end of the flow guide pipe 200 is disposed at an angle of 90° relative to the central axis of the first end of the flow guide pipe 200, i.e., one end of the flow guide pipe 200 connecting to the door seal frame 100 is relatively vertical to the other end thereof. The dry and hot air in the drying duct 20 is introduced by the first end of the flow guide pipe 200 exposed to the outside of the door seal frame 100 into the flow guide pipe 200 and is blown to the clothing in the inner cylinder 32 under the guidance of the flow guide pipe 200 to dry the clothing. The structure of the flow guide pipe 200 in this embodiment is more matched with the structure of the conventional roller-type combined washing and drying machine, and has high drying efficiency.

Figure 1A:
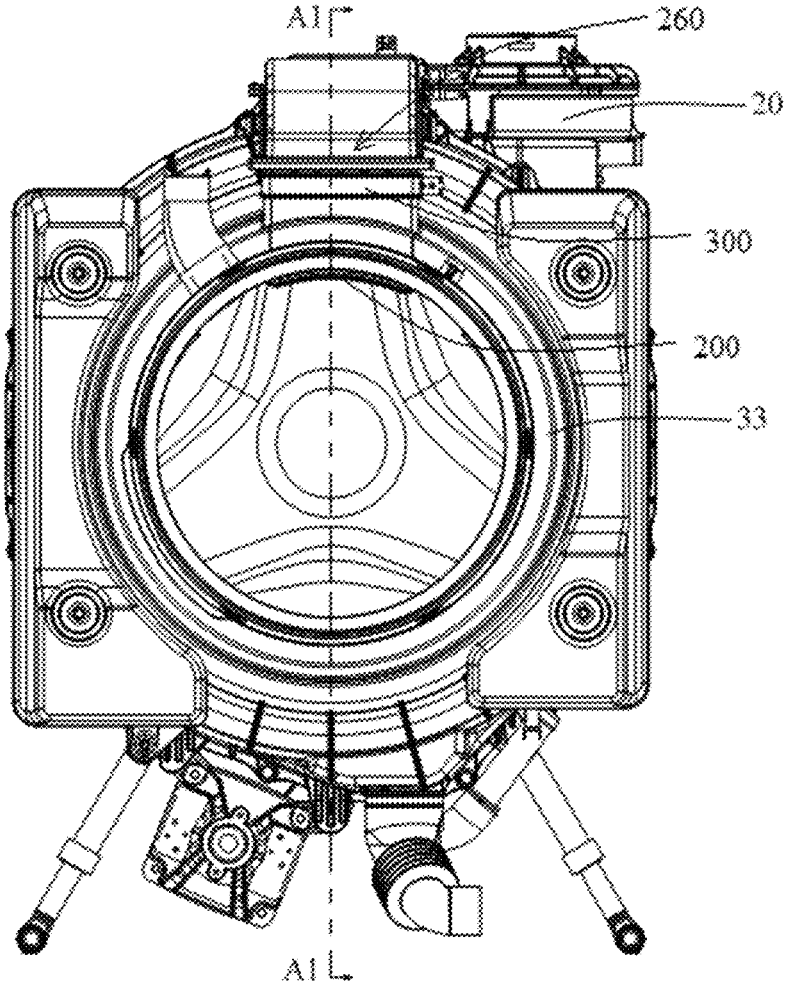
FIG. 1 is a perspective view of the combined washing and drying machine according to an embodiment of the present disclosure.
FIG. 1*b* is another perspective view of the combined washing and drying machine according to an embodiment of the present disclosure.
Figure 1B:
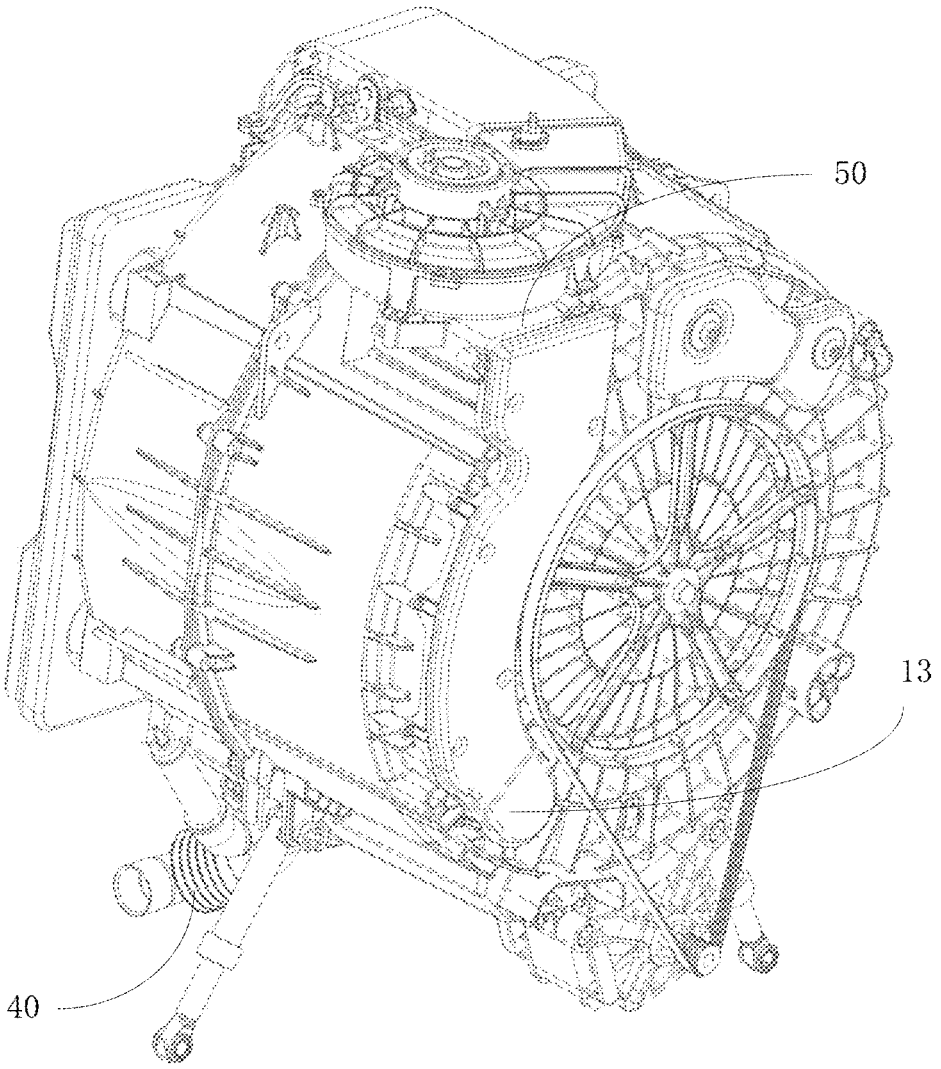

Referring to FIG. 1*a*, in another embodiment of the present disclosure, the door seal frame 100 is provided with a flow guide hole (not visible) penetrating the door seal frame 100, the outer opening of the flow guide hole is connected with the drying duct 20 of the combined washing and drying machine, and the flow guide pipe 200 is fixedly connected to the inner opening of the flow guide hole.

Specifically, in this embodiment, the flow guide hole is provided on the wall of the door seal frame 100 and passes through the door seal frame 100. The opening direction of both ends of the flow guide hole are parallel to the sealing window 102 on the door seal frame 100, an outer side opening is connected with the drying duct 20 and an inner side opening is connected to the first end of the flow guide pipe 200. The second end of the flow guide pipe 200 not communicating with the flow guide hole is provided toward the inner cylinder 32 of the combined washing and drying machine. The dry and hot air in the drying duct 20 inputs the flow guide pipe 200 from the flow guide hole, and is turned under the guidance of the flow guide pipe 200 to directly blow to the clothing in the inner cylinder 32, which is more convenient, quicker and has a high drying efficiency. At the same time, the door seal frame 100 is integrally provided with the flow guide pipe 200, thereby reducing the space occupied.

Further, the flow guide pipe 200 also includes an adapter groove 300 provided outside the door seal frame 100 and communicating with the flow guide hole through which the flow guide hole is connected with the drying duct 20. The shape of the adapter groove 300 corresponds to that of the drying duct 20.

In this embodiment, by providing the adapter groove 300 adapted to the shape of the drying duct 20, the seal between the drying duct 20 and the flow guide hole is tighter, and the detachment is more convenient, thereby facilitating replacement and maintenance.

The adapter groove 300 and the flow guide pipe 200 are fixedly mounted to the flow guide hole in a plurality of ways, such as screw, bonding, welding, or the like. The openings of the adapter groove 300 and the flow guide pipe 200 are slightly smaller than the port of the flow guide hole. In the installation, the adapter groove 300 and the flow guide pipe 200 can be directly inserted into the flow guide hole to complete the installation. The adapter groove 300 and/or the flow guide pipe 200 of the embodiment and the flow guide hole are easy to assemble and have a good airtightness.

At the same time, the adapter groove 300 and the flow guide pipe 200 may be formed by extending outwardly or inwardly of the wall of the door seal frame 100, but not fixed to the door seal frame 100.

The integrally formed adapter groove 300, the flow guide pipe 200 and the door seal frame 100 are more airtight and the overall structural design is more reasonable and occupies less space.

Further, the inner surface of one end of the adapter groove 300 connected to the drying duct 20 is provided with a sealing rib (not visible).

The dry and hot air in the drying duct 20 inputs the flow guide hole from the adapter groove 300. The sealing quality of the connection between the adapter groove 300 and the drying duct 20 is very important. For this reason, in this embodiment, a plurality of sealing ribs are protruded from the inner surface of one end of the adapter groove 300 connected to the drying duct 20, and the user is prevented from being exposed to high temperature air flow and burned, thereby improving using experience of the user.

The foregoing is merely preferred embodiments of the present disclosure and is not intended to limit the scope of the invention. Equivalent structural changes or direct or indirect application in other related technical fields, made by the present specification and the accompanying drawings, are within the scope of the patent protection of the present disclosure without departing from the principles of the present disclosure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A combined washing and drying machine, comprising a roller, a condenser, a drying duct, a water inlet and a drainage, wherein a hot and humid air inlet of the condenser is connected with the roller, a dry air outlet of the condenser is connected with an air inlet of the drying duct, and an air outlet of the drying duct is connected with the roller to form a cycle wind path; the condenser is connected to the water inlet and the drainage respectively, water is configured to be input into the condenser through the water inlet, and water after heat exchange with hot and humid air is configured to be discharged from the condenser through the drainage, and a plurality of water outlet holes are distributed in the water inlet; wherein the water inlet comprises at least two bar-shaped containers, a hollow main body, and a water inlet joint, each bar-shaped container having an opening end, each opening end of the at least two bar-shaped containers being respectively connected with the water inlet joint, the at least two bar-shaped containers being parallelly provided, the hollow main body is disposed between two adjacent bar-shaped containers of the at least two bar-shaped containers, one end of the hollow main body being provided with the water inlet joint;

wherein the condenser comprises a housing and at least one condensing plate, each condensing plate comprises a water inlet end, a water outlet end opposite the water inlet end, and at least one flow guide surface guiding water from the water inlet end to the water outlet end; a plurality of first heat exchange portions for slowing down flow rate of water flowing through each flow guide surface are protruded from each flow guide surface; the housing is disposed on an outer wall of the roller and encloses the roller to form a receiving cavity for receiving the at least one condensing plate, the receiving cavity being connected with the air inlet of the drying duct and the roller; and wherein each bar-shaped container comprises a closed end, the water flowing into an inner cavity of each bar-shaped container through the water inlet joint; each bar-shaped container is provided with a mounting portion for matching installation with each corresponding condensing plate of the condenser, each bar-shaped container comprising a first side and a second side corresponding to two plate surfaces of each corresponding condensing plate, and the first side and the second side are respectively provided with a plurality of the water outlet holes which are connected to the inner cavity of each bar-shaped container and are spaced apart along a direction from the opening end of each bar-shaped container to the closed end of each bar-shaped container.

2. The combined washing and drying machine of claim 1, wherein each first heat exchange portion is in a form of a plate, one end of each first heat exchange portion is fixed to each corresponding condensing plate and one other end opposite to the one end is suspended, a plate surface of each first heat exchange portion in the form of the plate faces a direction of the water inlet end, and each first heat exchange portion and each corresponding flow guide surface form an angle which opens toward the direction of the water inlet end, and the angle is greater than or equal to 90 degrees.

3. The combined washing and drying machine of claim 2, wherein each condensing plate comprises two flow guide surfaces disposed opposite to each other, and the two flow guide surfaces are respectively provided with the first heat exchange portions, the first heat exchange portions on the two flow guide surfaces of each condensing plate are staggered.

4. The combined washing and drying machine of claim 1, wherein a second heat exchange portion is provided on one side of the housing facing the at least one condensing plate.

5. The combined washing and drying machine of claim 1, wherein the condenser comprises at least two condensing plates disposed opposite to and spaced apart from each other, and the at least two condensing plates are connected to each other by at least one connecting member; the main body comprising two mounting walls arranged parallel and opposite to each other, the two mounting walls each having a first water tank communicating with the water inlet joint; each mounting wall is provided with a first plate adhered thereto and each first plate being provided with a second water tank in a position corresponding to the first water tank, and each first water tank and each corresponding second water tank constitute the inner cavity of each bar-shaped container.

6. The combined washing and drying machine of claim 5, wherein the plurality of water outlet holes on the first side of each bar-shaped container are on a same horizontal line and / or the plurality of water outlet holes on the second side are on a same horizontal line.

7. The combined washing and drying machine of claim 6, wherein the plurality of water outlet holes on the first side of each bar-shaped container and the plurality of water outlet holes on the second side are on a same horizontal plane.

8. The combined washing and drying machine of claim 5, wherein each bar-shaped container, on a position each of the plurality of water outlet holes locates, is provided with a flow guide groove for guiding the water flow of each water outlet hole to each condensing plate.

9. The combined washing and drying machine of claim 8, wherein each bar-shaped container, on a position each of the plurality of water outlet holes locates, is provided with two baffles disposed in a vertical direction, and the flow guide groove is formed between the two baffles.

10. The combined washing and drying machine of claim 5, wherein an overflow hole is provided on the first side and/or the second side of each bar-shaped container, a distance between the overflow hole and a corresponding location on bottom of the inner cavity of each bar-shaped container is greater than a distance between a water outlet hole and a corresponding location on bottom of the inner cavity of each bar-shape container.

* * * * *